US010624505B2

(12) United States Patent
Yan

(10) Patent No.: US 10,624,505 B2
(45) Date of Patent: Apr. 21, 2020

(54) FOAM SOAP DISPENSER

(71) Applicant: Jianzhi Yan, Guangzhou (CN)

(72) Inventor: Jianzhi Yan, Guangzhou (CN)

( * ) Notice: Subject to any disclaimer, the term of this patent is extended or adjusted under 35 U.S.C. 154(b) by 106 days.

(21) Appl. No.: 15/566,747

(22) PCT Filed: Sep. 2, 2016

(86) PCT No.: PCT/CN2016/097859

§ 371 (c)(1),
(2) Date: Oct. 16, 2017

(87) PCT Pub. No.: WO2017/067334

PCT Pub. Date: Apr. 27, 2017

(65) Prior Publication Data

US 2019/0008331 A1 Jan. 10, 2019

(30) Foreign Application Priority Data

Oct. 24, 2015 (CN) ..... 2015 1 0708227
Oct. 30, 2015 (CN) ..... 2015 2 0864960 U
(Continued)

(51) Int. Cl.
*A47K 5/16* (2006.01)
*A47K 5/12* (2006.01)
*A47K 5/14* (2006.01)

(52) U.S. Cl.
CPC ..... *A47K 5/16* (2013.01); *A47K 5/12* (2013.01); *A47K 5/1207* (2013.01);
(Continued)

(58) Field of Classification Search
CPC ..... A47K 5/14; A47K 5/16; A47K 5/1207; A47K 5/1217; A47K 2005/1218
(Continued)

(56) References Cited

U.S. PATENT DOCUMENTS 1,070,759 A * 8/1913 Toh et al. ..... B65G 15/02 198/623
3,706,690 A 12/1972 Duve et al.
(Continued)

FOREIGN PATENT DOCUMENTS

CN 102793495 11/2012
CN 204306724 5/2015
(Continued)

OTHER PUBLICATIONS

A translation along with the original language of the Description of CN204306724, Chongqing City Man College; Yan Xun, May 2015, provided via Espace.net services.*
(Continued)

*Primary Examiner* — Vishal Pancholi
*Assistant Examiner* — Andrew P Bainbridge
(74) *Attorney, Agent, or Firm* — Medler Ferro Woodhouse & Mills PLLC

(57) ABSTRACT

The present invention relates to the technical field of soap dispenser, particularly to a foam soap dispenser including a housing, a raw material chamber, and a liquid soap outlet, and further includes a water chamber, a drive device, and a foaming device; the liquid soap outlet is arranged on the housing; the raw material chamber, the water chamber, the drive device, and the foaming device are arranged inside the housing; a raw material chamber outlet and a water chamber outlet are connected to a foaming device inlet; a foaming device outlet is connected to the soap liquid outlet. The present invention can produce plentiful foam, and the piston assembly thereof is not easy to be stuck, and is provided with a longer service life. Moreover, the produced foam has a uniform size while the discharge speed of foam is faster and more stable than ever.

6 Claims, 34 Drawing Sheets

(30) Foreign Application Priority Data

Apr. 18, 2016 (CN) ..... 2016 1 0240701
Jul. 13, 2016 (CN) ..... 2016 1 0555246

(52) U.S. Cl.
CPC ..... *A47K 5/1208* (2013.01); *A47K 5/1217* (2013.01); *A47K 5/14* (2013.01)

(58) Field of Classification Search
USPC ..... 222/63, 186, 190, 325, 332, 383.1
See application file for complete search history.

(56) References Cited

U.S. PATENT DOCUMENTS 8,480,967 B2 * 7/2013 Zlatic ..... A47K 5/1202 137/268
9,867,507 B2 * 1/2018 Toh ..... A47K 5/14
2008/0277421 A1 * 11/2008 Zlatic ..... A47K 5/16 222/136
2013/0206794 A1 * 8/2013 McNulty ..... A47K 5/1202 222/136
2015/0315771 A1 * 11/2015 Abramson ..... B01F 15/0256 4/678
2018/0265345 A1 * 9/2018 Marshall ..... A47K 5/1202
2019/0059659 A1 * 2/2019 Burgo, Sr. ..... A47K 5/1217

FOREIGN PATENT DOCUMENTS

CN 105231927 1/2016
CN 205144423 4/2016
CN 105708375 6/2016

OTHER PUBLICATIONS

International Search Report and Written opinion issued in PCT/CN2016/097859, dated Nov. 25, 2016.

* cited by examiner

FOAM SOAP DISPENSER

TECHNICAL FIELD

The present invention relates to the technical field of soap dispenser, and more particularly to a foam soap dispenser.

BACKGROUND

The existing detergents and personal care products in the market, such as hand washing, cleanser essence, shampoo, shower gel, facial cleanser, toothpaste and so on, have to be mixed with water and rubbed by hand for foaming before use. If these products are used directly without water, no foam would be created, which make user's skin more susceptible to damage with the concentrated liquid soap. In addition, foaming the liquid soap by hand is prone to cause a great waste and be harmful to the environment because a large amount of liquid soap may be used than necessary.

The soap dispenser is an apparatus which can be squeezed to dispense liquid soap for users to clean their hands and faces. The soap dispenser essentially includes a liquid receiving bottle or a liquid container for receiving liquid soap, and a pumping device having a spray nozzle and being configured for pumping the liquid soap. The pumping device is arranged on the liquid receiving bottle or the liquid container. However, the out-of-date soap dispenser which simply outputs liquid soap cannot satisfy the pursuit of comfortable life style of contemporary people anymore. Therefore, the foam soap dispenser which can foam the common liquid soap when it is output comes into being. Generally, there are two types of foam soap dispensers, one of which has a piston assembly provided behind a grid-like or mesh-like barrier. When the piston assembly moves, the air is mixed with the liquid and discharged out through the mesh/grid. Foam is generated by the mixing action and division by mesh/grid. However, by doing so only a few of foam can be generated and the piston assembly is struggling with being stuck and short of service life. The other one is using the combination of screws and sleeves to draw the liquid and then deliver the liquid to a compact gear pump. The rotation of the gear in the gear pump mixes air and liquid together to produce foam. However, by doing so the produced foam would be very different in size. In this case, the arrangement of the grid-like or mesh-like barrier would be necessary, and the arrangement of the grid-like or mesh-like barrier turns out to be a trouble slowing down the speed of the discharging liquid because the liquid soap is blocked. Furthermore, the foam is discharged from the air vent and dropped easily. The screw-type liquid-pumping device has a problem of backflow which slows down the speed of second liquid pumping, resulting in an unstable foam volume. Additionally, the assembly is struggling with being stuck, short of service life and easy of leakage.

SUMMARY OF THE INVENTION

In view of the above-mentioned drawbacks of the prior art, the present invention aims to provide a foam soap dispenser to solve the deficiencies of the prior art.

In order to achieve the above objectives, the present invention provides the following technical solutions.

A foam soap dispenser comprises a housing, a raw material chamber, and a liquid soap outlet, and further comprising a water chamber, a drive device, and a foaming device. The liquid soap outlet is arranged on the housing. The raw material chamber, the water chamber, the drive device and the foaming device are arranged inside the housing. A raw material chamber outlet and a water chamber outlet are connected to a foaming device inlet. A foaming device outlet is connected to the liquid soap outlet.

Preferably, the foam soap dispenser further comprises a mixing device. The mixing device includes a feed port connected to a discharge port of the raw material chamber, a water inlet connected to a water outlet of the water chamber, and a discharge port thereof connected to the foaming device inlet. The liquid soap outlet is connected to the foaming device. The drive device is connected to the mixing device and the foaming device, respectively, and serves as power source for the mixing device and the foaming device simultaneously.

Furthermore, a flow-adjustable pumping component is provided between the water outlet of the water chamber and the water inlet of the mixing device. The pumping component is connected to the drive device, and the drive device is used as power source of the pumping component.

Furthermore, the mixing device includes a mixing vessel. The mixing vessel is internally provided with a mixing chamber. The mixing chamber is internally provided with a drive gear and a driven gear, both of which are arranged in vertical direction and engaged with each other. The feed port and the water inlet of the mixing device are located in a top wall of the mixing vessel, on top of the drive gear and the driven gear, respectively. The discharge port of the mixing device is located in a side wall of the mixing vessel.

Furthermore, the drive device includes a rotary shaft connected to the drive gear, and a transmission component connected to the rotary shaft. The transmission component is connected to and actuates the pumping component.

Furthermore, the pumping component includes a pressure pump. The pressure pump includes a connecting rod which reciprocates to actuate an operation of the pressure pump. The transmission component includes an eccentric sheathed on the rotary shaft. An end of the connecting rod is sheathed on the eccentric.

Furthermore, a pipe that connects a pressure pump outlet with the water inlet of the mixing device, is provided with a water shutoff valve. When the pressure pump is operating, a passageway is formed through the water shutoff valve. When the pressure pump is paused, the water shutoff valve is automatically closed.

Furthermore, the water shutoff valve includes a valve housing, an inner housing fitted within the valve housing, and an elastic sheet held between the valve housing and the inner housing. The valve housing is provided with a valve outlet. The inner housing is provided with a valve inlet. A flowing channel is formed between the valve inlet and the valve outlet. A blocking part of the elastic sheet corresponding to the flowing channel is provided with an opening slit. The blocking part is divided into a plurality of retractable elastic valves by the opening slit.

Furthermore, the drive device includes a drive motor, a first gear connected to a periphery of the rotary shaft, and a second gear engaged with the first gear. A drive shaft on which the second gear is mounted is connected to and actuates the foaming device.

Furthermore, the foaming device includes a foaming housing. A cavity inside the foaming housing is provided with a foam-rubbing gear mechanism. The foam-rubbing gear mechanism includes a main gear and a pinion, both of which constitute a gear pair. One side wall of the foaming housing is provided with the foaming device inlet. An opposite side wall thereof is provided with a spray nozzle used as the liquid soap outlet. The drive device is connected to and actuates the main gear or the pinion.

Furthermore, a trigger device electrically connected to the drive device is further included. The trigger device includes a pressing plate, a trigger connecting rod, a trigger switch, and a linkage plate. An end of the pressing plate is hinged to a bottom of the housing in lateral direction. An other end of the pressing plate is a free end. The trigger connecting rod is arranged in vertical direction. A bottom end of the trigger connecting rod is connected to the free end. A top end of the trigger connecting rod is fixed to the linkage plate. The trigger switch is located above the pressing plate and fixed to the housing. The trigger switch is located in a vertical translation path of the linkage plate.

In the above-mentioned technical solution, a paste-like or thick liquid soap raw material is mixed with water in the mixing device to be diluted to a proper concentration. Thereafter, the liquid soap enters the foaming device, so that the foam is produced and discharged. Accordingly, the requirement for foam production and discharge of the liquid soap raw material with high concentration can be satisfied, the restrictions of use are reduced, and it is more suitable for people to use. Additionally, both the mixing device and foaming device are actuated by one drive device, such that the space occupation of the soap dispenser is significantly reduced, making the soap dispenser more compact.

Preferably, the foam soap dispenser comprises a housing having a liquid soap outlet. The housing is internally provided with a foaming device, a drive device, a raw material chamber, and a water chamber. A pipe that connects the foaming device inlet and the water outlet of the water chamber is provided with a liquid dispensing and transmitting device. A pipe that connects the foaming device inlet and the discharge port of the raw material chamber is provided with a raw material dispensing and transmitting device. The foaming device outlet is connected to the liquid soap outlet. The drive device is connected to the raw material dispensing and transmitting device and the foaming device, and serves as power source for the raw material dispensing and transmitting device and the foaming device, simultaneously.

Furthermore, the drive device is connected to the liquid dispensing and transmitting device and serves as power source therefor.

Furthermore, the foaming device inlet is connected with a mixing pipe. The mixing pipe includes a liquid inlet connected to the liquid dispensing and transmitting device, and a feed port connected to the raw material dispensing and transmitting device.

Furthermore, the raw material dispensing and transmitting device comprises a material-pumping pressure pump. The material-pumping pressure pump includes a first connecting rod which reciprocates to actuate a self-operation. The drive device includes a power rotary shaft. The power rotary shaft is provided with a first eccentric. An end of the first connecting rod is connected to a peripheral surface of the first eccentric.

Furthermore, an inlet pipe and an outlet pipe of the material-pumping pressure pump are provided with a material shutoff valve. When the material-pumping pressure pump is operating, a passageway is formed through the material shutoff valve. When the material pumping pressure pump is stopped, the material shutoff valve is automatically closed.

Furthermore, the material shutoff valve includes a valve housing, an inner housing fitted within the valve housing, and an elastic piece held between the valve housing and the inner housing. The valve housing is provided with a valve outlet. The valve inner housing is provided with a valve inlet. A flowing channel is formed between the valve inlet and the valve outlet. A blocking part of the elastic piece corresponding to the flowing channel is provided with an opening slit. The blocking part is divided into a plurality of retractable elastic valves by the opening slit.

Furthermore, the liquid dispensing and transmitting device comprises a liquid-pumping pressure pump. The liquid-pumping pressure pump includes a second connecting rod which reciprocates to actuate a self-operation. The power rotary shaft is connected with a second eccentric. An end portion of the second connecting rod is connected to a peripheral surface of the second eccentric.

Furthermore, the outlet pipe of the liquid-pumping pressure pump is provided with a water shutoff valve. When the liquid-pumping pressure pump is operating, a passageway is formed through the water shutoff valve. When the liquid-pumping pressure pump is stopped, the water shutoff valve is automatically closed.

Furthermore, the foaming device includes the foaming housing. The cavity inside the foaming housing is provided with the foam-rubbing gear mechanism. The foam-rubbing gear mechanism includes the main gear and the pinion, both of which constitute the gear pair. One side wall of the foaming housing is provided with the foaming device inlet. The opposite side wall thereof is provided with the spray nozzle used as the liquid soap outlet. The drive device includes a transmission shaft connected to, and actuating the main gear or the pinion. Moreover, the transmission shaft coordinates with the power rotary shaft.

Furthermore, the trigger device electrically connected to the drive device is further included. The trigger device includes the pressing plate, the trigger connecting rod, the trigger switch, and the linkage plate. The end of the pressing plate is hinged to the bottom of the housing in lateral direction. The other end of the pressing plate is the free end. The trigger connecting rod is arranged in vertical direction. The bottom end of the trigger connecting rod is connected to the free end. The top end of the trigger connecting rod is fixed to the linkage plate. The trigger switch is located above the pressing plate and fixed to the housing. The trigger switch is located in the vertical translation path of the linkage plate.

In the above-mentioned technical solution, the foaming device inlet is connected to the water chamber and the material chamber via pipes, respectively, to form a dual-path soap dispenser. With the effect of the liquid dispensing and transmitting device and the material dispensing and transmitting device, the water and the paste-like or thick liquid soap raw material can arrive at the foaming device inlet at a proportion at the same time. After materials entering the foaming device are diluted, the requirement for foam production and discharge of the paste-like or thick liquid soap raw material can be satisfied, such that the restrictions of use are reduced and it is more suitable for people to use.

Preferably, the foam soap dispenser comprises a housing having a liquid soap outlet. The housing is internally provided with a mixing device, a foaming device, a drive-pumping device, a raw material chamber, and a water chamber. The mixing device includes a feed port connected to a discharge port of the raw material chamber, a water inlet connected to a water outlet of the water chamber, and a discharge port connected to the foaming device inlet. The liquid soap outlet is connected to the foaming device. The drive-pumping device is connected to the mixing device and the foaming device, and serves as power source for the mixing device and the foaming device simultaneously, wherein the mixing device includes a mixing-diluting-transmitting housing, and a mixing vessel arranged on an upper portion of the mixing-diluting-transmitting housing. A side of a mixing-diluting-transmitting housing is provided with a transmitting chamber opening so as to form a transmitting chamber inside the mixing-diluting-transmitting housing. The transmitting chamber is internally provided with mixing straight tooth gear. The mixing vessel is provided with a mixing crown gear. A bottom of the mixing vessel is further provided with a mixing port connected to the transmitting chamber. An upper portion of the mixing crown gear is provided with stirring pieces. A central position of the mixing vessel is provided with a crown gear fixing cotter for fixing the mixing crown gear. A space between an outer rim of the crown gear fixing cotter and an inner rim of the mixing vessel forms a mixing groove. A lower portion of the mixing crown gear and the mixing straighttooth gear are engaged with each other in a mixing opening of the mixing groove. The mixing openings are arranged at an engaging point of the mixing crown gear and the mixing straight tooth gear.

Furthermore, the transmitting chamber opening of the mixing-diluting-transmitting housing is provided with a transmitting chamber cover for covering the transmitting chamber. The center of the transmitting chamber cover is sheathed around the rotary shaft, which rotary shaft is connected to the mixing straight gear. Moreover, the mixing straight gear is covered inside the transmitting chamber by means of the transmitting chamber cover.

Furthermore, an upper portion of a side adjacent to a transmitting chamber opening side of the mixing-diluting-transmitting housing is provided with a water inlet connected to the water chamber. The water inlet is connected to the mixing groove.

Furthermore, a lower portion of the mixing-diluting-transmitting housing is further provided with a first mixed liquid outlet and a second mixed liquid outlet. The first mixed liquid outlet is connected to the transmitting chamber. The first mixed liquid outlet is connected to the second mixed liquid outlet.

Furthermore, a side opposite to the transmitting chamber opening side of the mixing-diluting-transmitting housing is provided with a third mixed liquid outlet. The third mixed liquid outlet is connected to the second mixed liquid outlet. The third mixed liquid outlet is further connected to a liquid inlet of the foaming device.

Furthermore, the flow-adjustable pumping component is provided between the water outlet of the water chamber and the water inlet of the mixing device. The pumping component is connected to the drive-pumping device, and the drive-pumping device is used as power source for the pumping component.

Furthermore, the drive-pumping device includes the rotary shaft connected to the mixing straight gear, and the transmission component connected to the rotary shaft. The transmission component is connected to and actuates the pumping component.

Furthermore, the pumping component includes the pressure pump. The pressure pump includes a cup connecting rod which reciprocates to actuate the operation of the pressure pump. The transmission component includes the eccentric sheathed on the rotary shaft. An end of the cup connecting rod is sheathed on the eccentric.

Furthermore, the pipes that connect the pressure pump outlet and the water inlet of the mixing device are provided with the water shutoff valve.

Furthermore, the water shutoff valve includes the valve housing, the inner housing fitted within the valve housing, and a cross-shaped valve elastic sheet held between the valve housing and the inner housing. The valve housing is provided with the valve outlet. The inner housing is provided with the valve inlet. The flowing channel is formed between the valve inlet and the valve outlet. A blocking part of the cross-shaped valve elastic sheet corresponding to the flowing channel is provided with the opening slit. The blocking part is divided into a plurality of retractable elastic valves by the opening slit.

Furthermore, the drive-pumping device includes a drive motor. An output terminal of the drive motor is externally connected with a third gear. The third gear is externally engaged with the second gear. The second gear is externally engaged with the first gear. The first gear is mounted on the rotary shaft. An end of the rotary shaft is connected to the mixing straight gear of the mixing device, so as to actuate the mixing device.

Furthermore, a trigger device electrically connected to the drive-pumping device is further included. The trigger device includes a valve rubber arranged at the first mixed liquid outlet, and a valve fixing ring for fixing the valve rubber. The valve rubber is connected to a pulling rod arranged below the valve rubber. A reset spring is sheathed around the pulling rod. A bottom of the pulling rod is connected to the pressing plate.

In the above-mentioned technical solution, the mixing device is provided with the mixed groove to achieve the mixing of the water and the raw material at a proportion. The raw material can be well controlled, and the discharge of the liquid soap is effective. Moreover, since the mixing crown gear and the mixing straight gear are provided, the engagement of the mixing crown gear and the mixing straight gear can achieve an additional mixing of the raw material. Moreover, at a top of the mixing crown gear there is provided with the stirring pieces, so as to rub the raw material into the mixing groove easily, such that the mixing of the raw materials is more uniform. Additionally, the structure design of the whole soap dispenser is intellectual and compact, and user can simply trigger the pressing pieces of the trigger device to control the entire soap dispenser system at a time, such that a simple and efficient system without complicated process can be achieved. The drive-pumping device, the mixing device, and the foaming device can be simultaneously controlled by simply triggering the pressing pieces of the trigger device.

Preferably, the foam soap dispenser comprises a water tank, a raw material tank, a foaming device, a mixing device, and a drive device. The foam soap dispenser further comprises a mixed liquid pumping-transmitting device and a liquid pumping-transmitting device which are separately designed. The liquid pumping-transmitting device includes a first cam, a first connecting rod, a first pressure pump, a check valve, and a first one-way valve. A water outlet of the first one-way valve is connected to a water inlet of the first pressure pump. The mixed liquid pumping-transmitting device includes a second pressure pump, a third one-way valve, a second one-way valve, a second cam, and a second connecting rod. A water outlet of the second one-way valve is connected to a water inlet of the second pressure pump. A water outlet of the second pressure pump is connected to a water inlet of the third one-way valve. The mixing device includes a water inlet, a first mixed liquid outlet, a stirring chamber, a second mixed liquid outlet, a bearing, a mixing gear, a mixing cover, a stirring gear, and a mixing housing and a seal ring and a mixing chamber. A liquid inlet of the mixed liquid pumping-transmitting device is connected to the second mixed liquid outlet of the mixing device via the second one-way valve. A liquid outlet of the mixed liquid pumping-transmitting device is connected to the water inlet of the foaming device via the third one-way valve. The liquid inlet of the liquid pumping-transmitting device is connected to a water outlet of the water tank via the first one-way valve. The liquid outlet of the liquid pumping-transmitting device is connected to the water inlet of the mixing device via the check valve. The drive device is connected to the foaming device, the mixed liquid pumping-transmitting device, the mixing device, and the liquid pumping-transmitting device, and serves as power source for the foaming device, the mixed liquid pumping-transmitting device, the mixing device, and the liquid pumping-transmitting device simultaneously.

Furthermore, the drive device includes a motor gear, a center gear, a first auxiliary gear, a second auxiliary gear, and a third auxiliary gear. The motor gear is engaged with the second auxiliary gear, and a rotation of the second auxiliary gear is actuated by the motor gear. The second auxiliary gear, the center gear, the first auxiliary gear, and the third auxiliary gear are engaged in sequence.

Furthermore, the water inlet is arranged on the mixing cover. The mixing gear is arranged inside the mixing cover. The stirring gear is arranged in the stirring chamber inside the mixing housing. The stirring chamber is provided with the second mixed liquid outlet. The mixing cover is further provided with the first mixed liquid outlet. The stirring gear and the mixing gear are connected to an upper portion of a rotary connecting shaft. A connection point of the stirring gear and the rotary connecting shaft is provided with the seal ring. A lower portion of the rotary connecting shaft is connected to the second cam.

Furthermore, the foaming device includes a spray nozzle, a main gear, a first pinion, an upper foaming housing, a second pinion, a lower foaming housing, a drive shaft, an air inlet, and a mixed liquid inlet. An upper portion of the drive shaft is connected to the main gear. The main gear is engaged with the first pinion and the second pinion. The main gear, the first pinion, and the second pinion are arranged inside a housing formed by a snap-fit of the upper foaming housing and the lower foaming housing. The spray nozzle is arranged on the upper foaming housing. The lower foaming housing is provided with the air inlet and the mixed liquid inlet. A lower portion of the drive shaft is connected to the second auxiliary gear. An upper portion of the drive shaft is connected to the main gear.

Furthermore, the third auxiliary gear is connected to and actuates the second cam.

Furthermore, a rotation of the first cam is actuated by the center gear. The first cam is sheathed in a first annular ring located at a side of the first connecting rod. An other side of the first connecting rod is connected to a first cup arranged on the first pressure pump. The second cam is sheathed in a second annular ring located at a side of the second connecting rod. An other side of the second connecting rod is connected to a second cup arranged on the second pressure pump.

Furthermore, the first cam and the second cam both have an eccentric structure.

Furthermore, the mixing gear is provided with an inserting hole.

In the above-mentioned technical solution, the mixed liquid pumping-transmitting device and liquid pumping-transmitting device are designed separately, such that the water and the raw material can be mixed more accurately at a proportion to effectively produce foam. The drive device is properly designed as a gear assembly, such that multiple modules of the provided system can be actuated simultaneously, and the operation thereof is easy, time-saving and labor-saving, effective, and can reduce the manufacturing cost of the parts. Moreover, the mixing device of the foam soap dispenser adopts a intellectual structure design where the liquids can be mixed first and stirred subsequently. The rotation of the mixing gear mixes the liquid soap at first and the stirring gear carries out a fine stirring to completely mixture of the water and the raw material, such that the mixed liquid can be more uniform, and a good foundation for an effective foaming may be established.

In view of above, the present invention can produce plentiful foam, and the piston assembly thereof is not easy to be stuck, and is provided with a longer service life. Moreover, the produced foam has a uniform size while the discharge speed of foam is faster and more stable than ever.

DETAILED DESCRIPTION OF THE INVENTION

The concept, the specific structure, and the technical effects of the present invention will be further described with reference to the drawings, in order to clarify the objectives, features, and effects of the present invention completely.

Embodiment 1

A multi-functional foam soap dispenser, with reference to FIGS. 1-8, includes a housing a1 provided with a liquid soap outlet. The housing a1 is internally provided with a mixing device a2, a foaming device a4, a drive device a3, a raw material chamber a5, and a water chamber a6. Wherein, the mixing device a2 is provided with a feed port a24, a water inlet a25, and a discharge port a26. The feed port a24 is connected to a discharge port a51 of the raw material chamber a5 via a pipe. The water inlet a25 is connected to a water outlet a61 of the water chamber a6 via a pipe. The discharge port a26 of the mixing device a2 is connected to an inlet of the foaming device a4 via a pipe. The liquid soap outlet is connected to an outlet of the foaming device a4. Raw materials in the raw material chamber a5 and water in water chamber a6 may enter the mixing device a2 at the same time and be mixed and diluted, and then enter the foaming device a4 to produce foam. At last, the foam is discharged from the soap dispenser through the liquid soap outlet. Due to the use of diluting device and diluting step, not only the diluted raw materials can be processed, but also viscous raw materials with high concentration can be used to produce the foam, and even paste-like raw materials are acceptable. Therefore, the restriction of the existing soap dispenser to raw materials can be addressed by the present invention, such that the soap dispenser may be more suitable for people.

In addition, the mixing device a2 and foaming device a4 in the embodiment 1 are actuated by external forces to perform their intended function. In the present invention, one drive device a3 may be used as power source of the external forces simultaneously, such that the occupation of the entire soap dispenser can be significantly saved and therefore the soap dispenser is suitable for more applications.

Mixing device a2, foaming device a4, drive device a3, raw material chamber a5, and water chamber a6 will be described in detail hereinafter.

Figure 1:
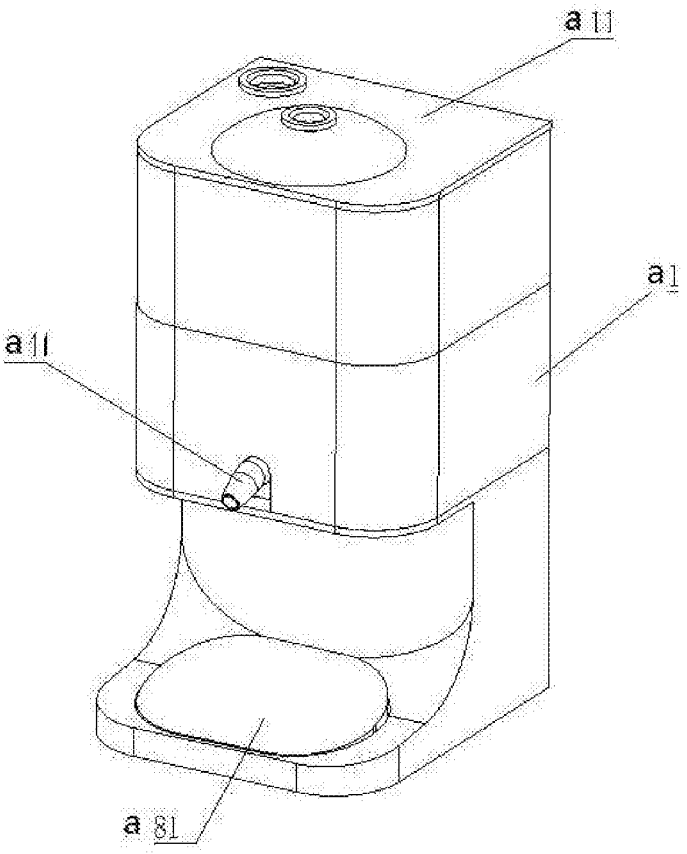
FIG. 1 is a schematic view of the appearance of the soap dispenser of embodiment 1.
Figure 2:
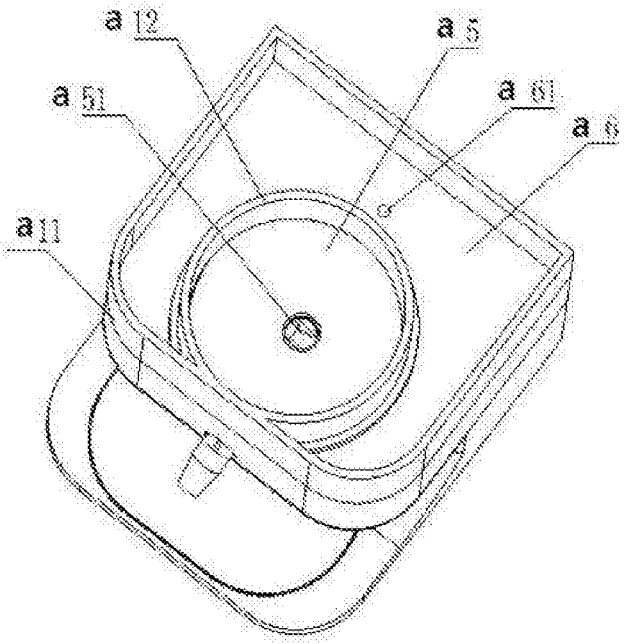
FIG. 2 is a schematic view of a top of a tank in embodiment 1.
Figure 3:
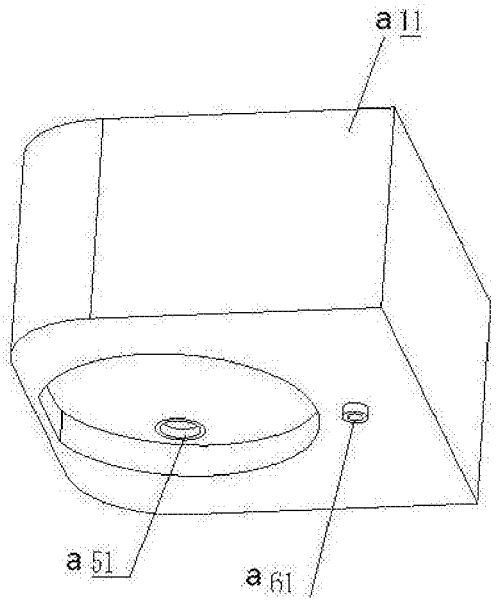
FIG. 3 is a schematic view of a bottom of the tank in embodiment 1.
Figure 4:
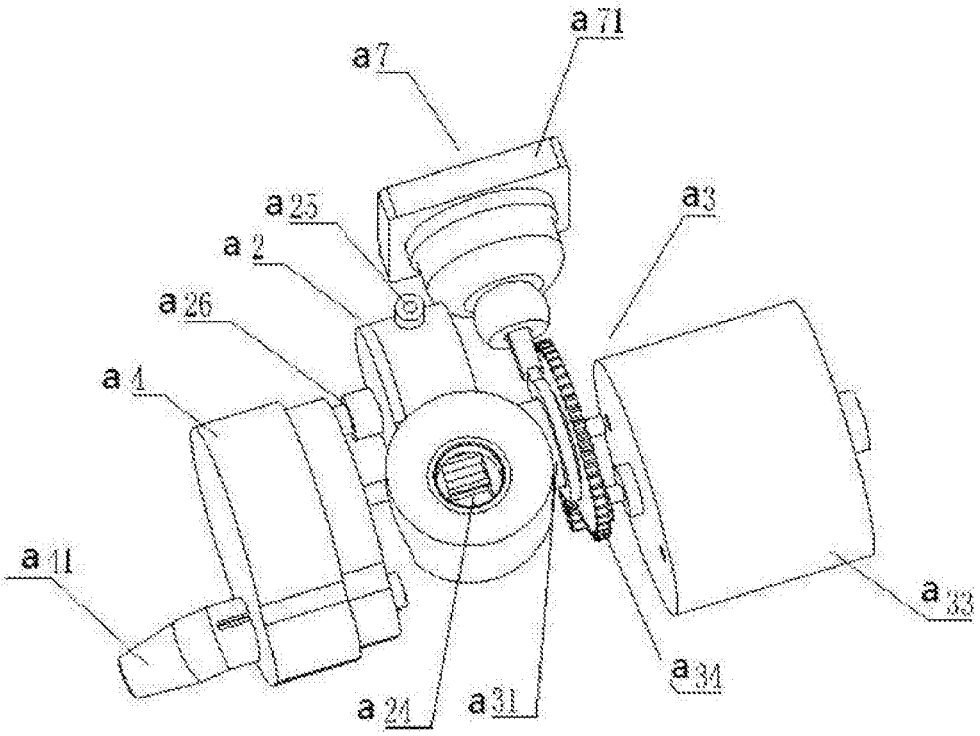
FIG. 4 is a structural schematic view of a connection of a foaming device, a mixing device, and a drive device in embodiment 1.

Referring to FIGS. 1-3, a tank a11 is arranged at a top of the housing a1. A middle portion of the tank a11 is provided with an annular wall a12 which divides the tank into a cylindrical raw material chamber a5 enclosed by the annular wall, and a water chamber a6 outside the annular wall. A bottom of the tank a11 is provided with two holes, one of which is connected to the raw material chamber a5 and serves as a discharge port a51 of the raw material chamber a5, while the other is connected to the water chamber a6 and serves as a water outlet a61 of the water chamber a6. Generally, the raw material chamber a5 is filled with raw materials for washing, while the water chamber a6 is alternatively filled with water as needed. Specifically, if the raw material chamber a5 is filled with a viscous or paste-like washing material, then the water chamber a6 may be filled with water, so that the concentration of the washing material can be reduced after water and viscous washing material enter the mixing device a2 and are mixed therein. If raw material chamber a5 is filled with a washing raw material with low concentration, it is considerable to unload the water chamber a6.

The embodiments described hereinafter are based on viscous washing materials.

Referring to FIGS. 4 to 10, in the embodiment 1, the washing material is supplied to the mixing device a2 in the form of gravity flow, namely, the feed port of the mixing device a2 is located below the raw material chamber a5. Since the water has a high fluidity, and the flow rate is hard to control, the flow-adjustable pumping component a7 is arranged between the water outlet of the water chamber a6 and the water inlet of the mixing device a2. Water is drawn into the mixing device a2 only when the pumping component a7 is operating. Moreover, the water capacity drawn into the mixing device a2 can be controlled to a certain extent by controlling the pumping capacity of the pumping component a7, so as to adjust the concentration of the mixture.

The pumping component a7 needs to be actuated by the external power. Preferably, the pumping component a7 is connected to and actuated by the drive device a3, which is served as power source, such that the space occupation of the soap dispenser is effectively saved. The pumping component a7 and the connection between the pumping component a7 and the drive device a3 will be described below.

Figure 6:
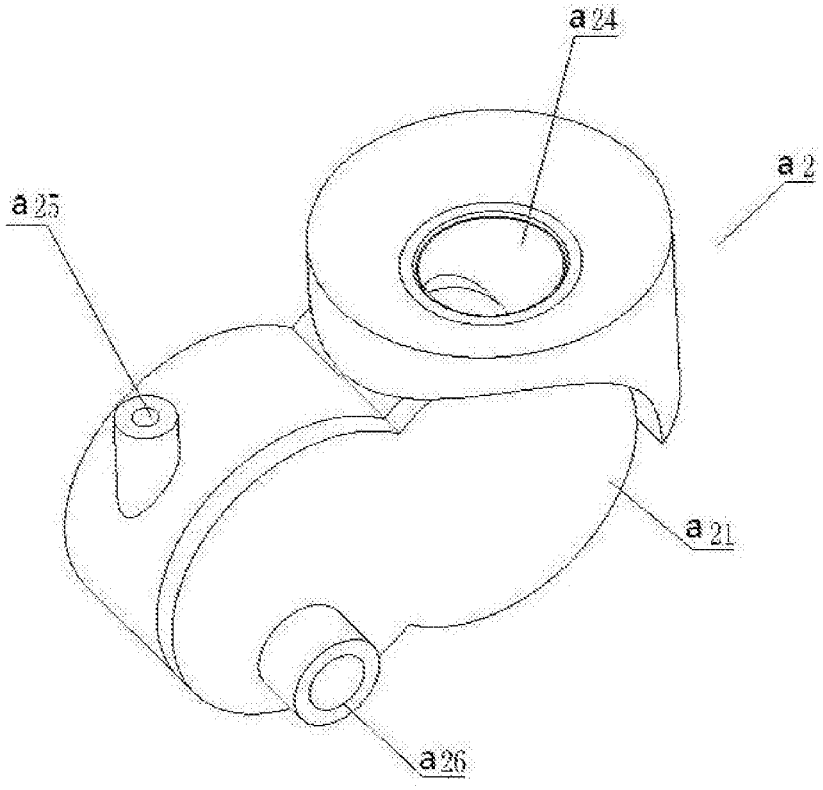
FIG. 6 is a schematic view of an appearance of the mixing device in embodiment 1.
Figure 7:
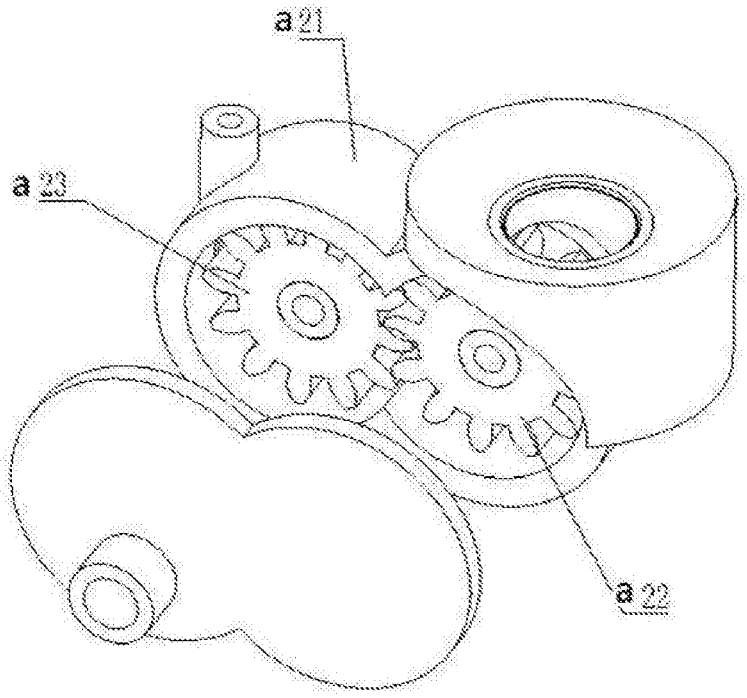
FIG. 7 is a structural schematic view of an interior of the mixing device in embodiment 1.

Referring to FIGS. 6 and 7, in the embodiment, the mixing device a2 includes a mixing vessel a21. The mixing vessel a21 is internally provided with a mixing chamber. The mixing chamber is shaped as a horizontally placed number "8". The drive gear a22 and the driven gear a23 are vertically provided inside the mixing chamber. Each of the two gears occupies a half of the mixing chamber, respectively, and the two gears are engaged with each other. The feed port a24 and the water inlet a25 of the mixing device a2 are located in a top wall of the mixing vessel a21, respectively. Moreover, the feed port a24 is located above the drive gear a22 and connected to the mixing chamber. The feed port a24 is connected to the raw material chamber a5 via a funnel-shaped pipe. The water inlet is located above the driven gear a23 aside. The discharge port a26 of the mixing device a2 is located in a side wall of the mixing vessel a21. The side wall is opposed to an end surface of the driven gear a23. The drive gear a22 is a power gear actuated by the drive device a3. When the drive gear is not actuated yet, the passageway communicated with the raw material chamber a5 above the gear is filled with viscous washing material, and the fluidity is extremely poor. When the drive device a3 is operating, the washing material is actuated by the drive gear a22 and uniformly pumped into the mixing chamber. At the same time, the pumping component a7 is actuated to pump water toward the mixing chamber, and water is subsequently pumped into the mixing chamber by the driven gear a23 to be mixed with the washing material, effectively. Thereafter, the mixture flows out from the discharge port a26 of mixing vessel a21. The mixing ratio of the mixture is controllable. For example, the mixing ratio can be controlled by adjusting the flow rate of the pumping component a7, or adjusting the modules, thickness, number of teeth, etc. of drive gear a22 and driven gear a23, as described above.

Referring to FIGS. 4, 5, and 8 to 10, in the embodiment, the pumping component a7 includes a pressure pump a71. The pressure pump a71 includes a connecting rod a711 which reciprocates to actuate a self-operation.

A one-way valve is arranged between the inlet of pressure pump a71 and the water chamber a6 to prevent water from flowing back into the water chamber a6 during the pumping process. Moreover, a pipe connecting the outlet of pressure pump a71 with the water inlet of the mixing device a2 is provided with the water shutoff valve a72. The water shutoff valve a72 is different than the one-way valve a73. When the pressure pump a71 is operating, the water shutoff valve a72 forms a passageway, and water can flow into the mixing vessel a21. However, when the pressure pump a71 is stopped, the water shutoff valve a72 is automatically closed to prevent water flow from flowing into the mixing vessel a21 under the action of gravity.

Figure 11:
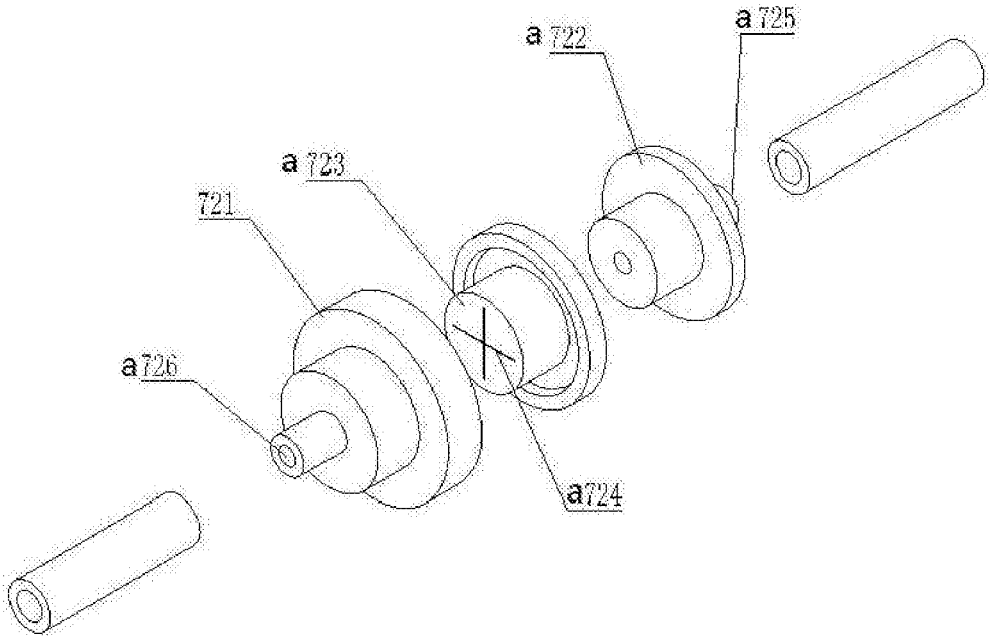
FIG. 11 is an exploded view of a water shutoff valve of embodiment 1.

Specifically, referring to FIG. 11, the water shutoff valve a72 includes a valve housing a721, an inner housing a722 fitted within the valve housing a721, and an elastic sheet a723 (silicone sheet) held between the valve housing a721 and the inner housing a722. The valve housing a721 is provided with a valve outlet a726, the inner housing a722 is provided with a valve inlet a725, and a water flowing passage is formed between the valve inlet a725 and the valve outlet a726. A part of held portion of the elastic sheet a723 blocks the flowing passageway. The blocking part is provided with a cross-shaped opening slit a724 penetrating the entire elastic sheet a723, such that the blocking part is divided into four retractable elastic valves. If the pressure pump a71 is operating, a water flow is formed with a certain pressure, the pressurized water will crash and open the elastic valves, so that the water can flow through the water shutoff valve a72. However, if the pressure pump a71 is not operating, the water flow will not have a pressure or the pressurized water is too weak to neutralize the elastic force of the elastic valves and thereby the elastic valves, such that the water flow will be blocked by the elastic valves and unable to pass through the water shutoff valve a72. This type of water shutoff valve allows water to flow through the valve selectively, thus, there is no need for manual opening and closing, which will bring a great convenience to users.

Figure 12:
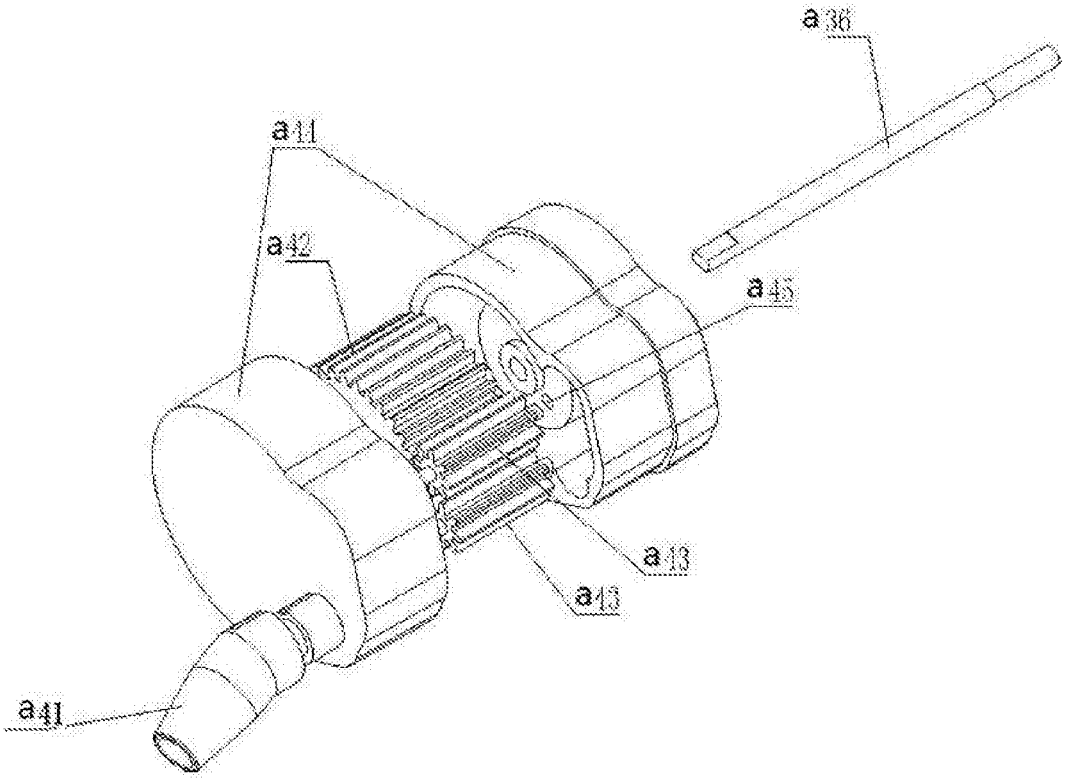
FIG. 12 is a structural schematic view of the foaming device in the embodiment 1.

Referring to FIG. 12, in the embodiment, the foaming device a4 includes a foaming housing a44. The cavity inside the foaming housing a44 is provided with a foam-rubbing gear mechanism. The foam-rubbing gear mechanism includes a main gear a42 and two pinions a43, all of which constitute gear pairs. A side wall of the foaming housing a44 is provided with an inlet of the foaming device a4. An opposite side wall is provided with a spray nozzle a41 serving as the liquid soap outlet, and the spray nozzle a41 is used as the liquid soap outlet for the entire soap dispenser. The drive shaft a36 of the drive device a3 is connected to and actuates one of the main gear a42 or the pinions a43. The foaming housing a44 is further provided with an air inlet a45. The air inlet a45 is used to draw in air. When the main gear a42 engaging with two pinions a43 is rotating, the mixture entering foaming housing a44 is mixed and grinded with the indrawn air to produce the foam soap.

Referring to FIGS. 4, 5, 8 to 10, and 12, in the embodiment, the drive device a3 includes a rotary shaft a31, a transmission component, a drive motor a33, a first gear a34, a second gear a35, and the drive shaft a36. The drive motor a33 is used as total power source for the entire drive device a3.

Furthermore, an output terminal of drive motor a33 is externally connected to a third gear a37. The third gear a37 is externally engaged with the second gear a35. The second gear a35 is a gear set, substantially. The gear set is externally engaged with the first gear a34, so that the rotation of both the second gear a35 and the first gear a34 is directly actuated by the drive motor a33.

The second gear a35 is mounted on one drive shaft a36. The drive shaft a36 extends laterally to the main gear a42 or the pinion a43 connected to foaming device a4, so as to actuate foaming device a4.

The first gear a34 is mounted on one rotary shaft a31 parallel to the drive shaft a36. An end of the rotary shaft a31 is connected to the drive gear a22 of mixing device a2, so as to actuate the mixing device a2.

The transmission component is connected to the rotary shaft a31 and actuates the pumping component a7. Specifically, the transmission component includes an eccentric a32 peripherally sheathed around the rotary shaft a31. An end of the connecting rod a711 of the pressure pump a71 is sheathed on the eccentric a32. When the rotary shaft a31 actuates eccentric a32 to rotate, the connecting rod a711 will reciprocate so as to actuate the pumping of the pressure pump a71. Designers or users can design an eccentric a32 with different eccentric distances to adjust the pumping capacity of pressure pump a71.

Figure 5:
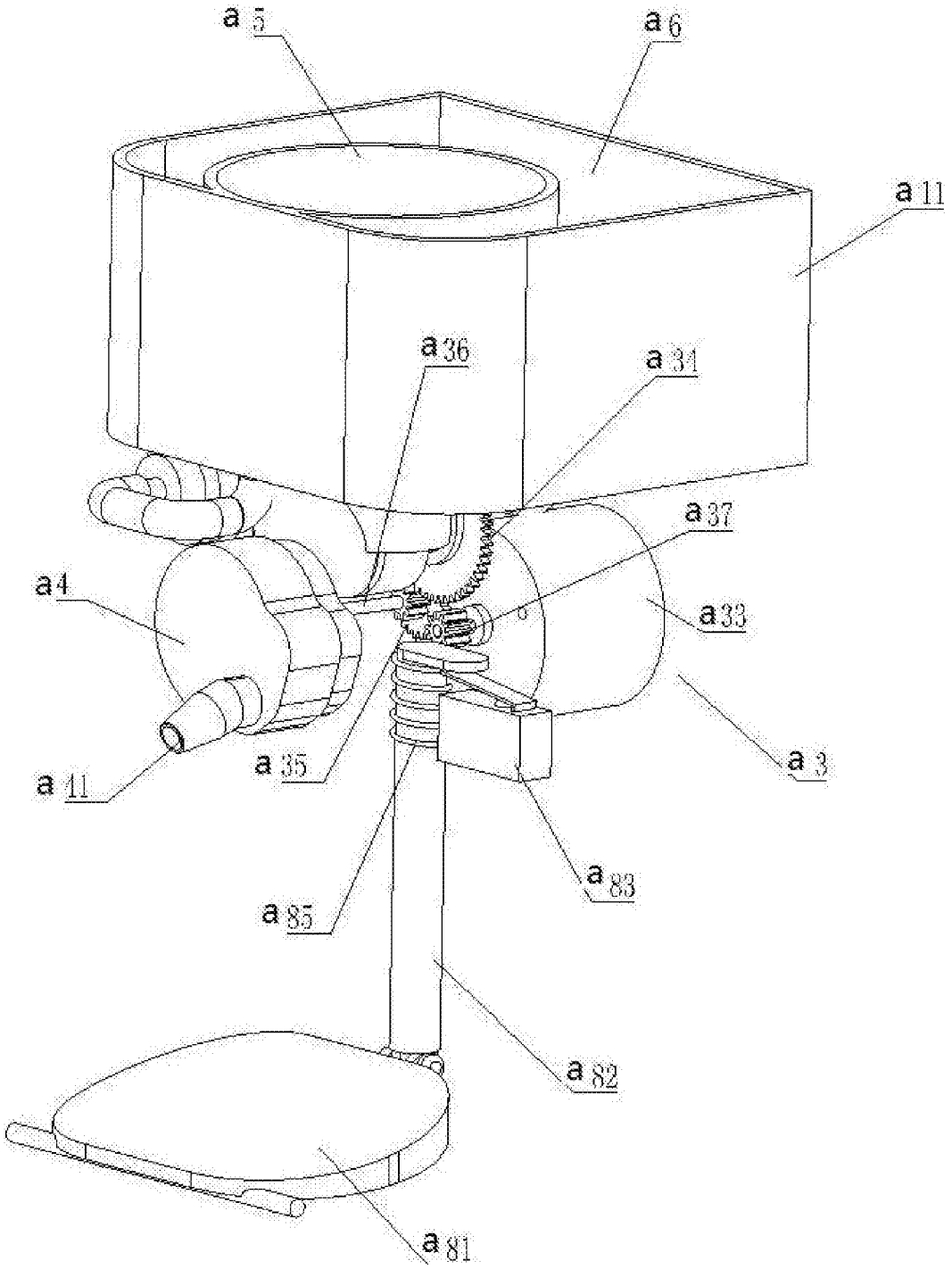
FIG. 5 is a structural schematic view of an interior of the soap dispenser in embodiment 1.
Figure 8:
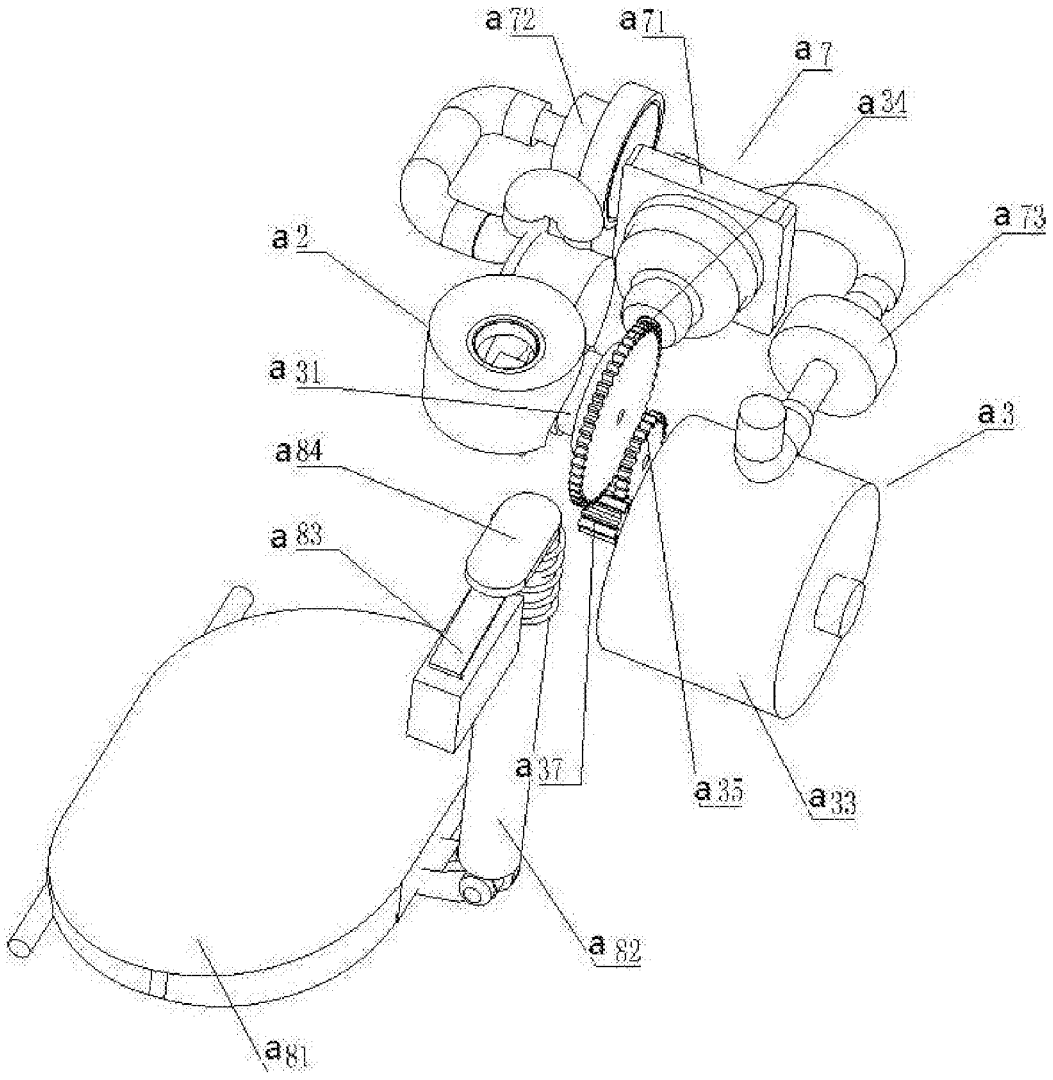
FIG. 8 is a structural schematic view of an interior which is hidden behind a housing and tank of the soap dispenser in embodiment 1.
Figure 9:
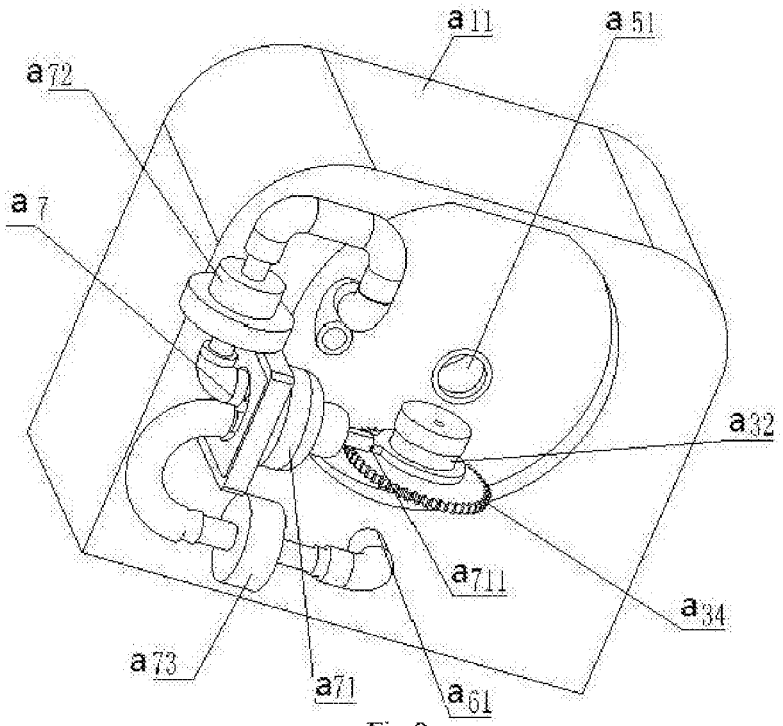
FIG. 9 is a schematic view of a connection between a pumping component and the tank and the drive device in embodiment 1.
Figure 10:
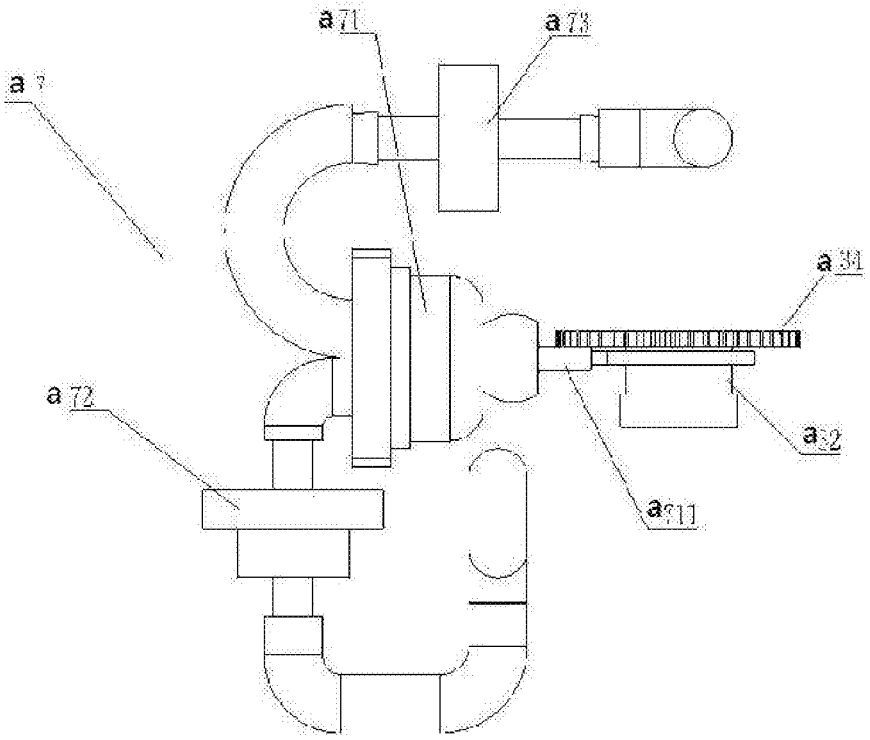
FIG. 10 is a top view of the pumping component in embodiment 1.

Additionally, referring to FIGS. 1, 5, and 8, the soap dispenser further includes a trigger device electrically connected to drive motor a33 to provide the user a simple switch on-off of drive motor a33. The trigger device includes a pressing plate a81, a trigger connecting rod a82, a trigger switch a83, and a linkage plate a84. A main body of the pressing plate a81 is exposed outside the housing a1 for easy operation. One end of the pressing plate a81 is laterally hinged to a bottom of the housing a1. The other end of the pressing plate is a free end which can be pressed. The trigger connecting rod a82 is vertically arranged perpendicular to the hinge shaft of the pressing plate a81. A bottom end of the trigger connecting rod a82 is connected to the free end, and a top end thereof is fixed to the linkage plate a84. The trigger switch a83 is a press-button switch located above the pressing plate a81 and fixed to the housing a1. The trigger switch a83 is located in the vertical translation path of the linkage plate a84. When the user presses or steps the pressing plate a81, the linkage plate a84 descends in the vertical direction subsequently as the trigger connecting rod a82 descends immediately. The trigger switch a83 is triggered during the descending process. Thereafter, the drive motor a33 and the drive device a3 are actuated. In order to make the trigger connecting rod a82 translate to a reset position upwardly after releasing the pressing plate a81, a periphery of the trigger connecting rod a82 sheathed at a lower end surface of the linkage plate a84 is provided with a reset spring a85, and a bottom end of the reset spring a85 is connected to housing a1.

The brief operation of the embodiment 1 is as follows.

When the trigger device is triggered, the drive device a3 actuates the pumping component a7, the mixing device a2, and the foaming device a4, simultaneously. The water is supplied to the mixing device a2 by the pumping component a7 at a proportion. At the same time, the mixing device a2 draws in the raw material from the raw material chamber a5 at a proportion to mix with the water sufficiently, so as to form a diluted mixture. The mixture is subsequently delivered to the foaming device a4 for foaming, and finally the foam is discharged from the soap dispenser via the spray nozzle a41.

Embodiment 2

Figure 13:
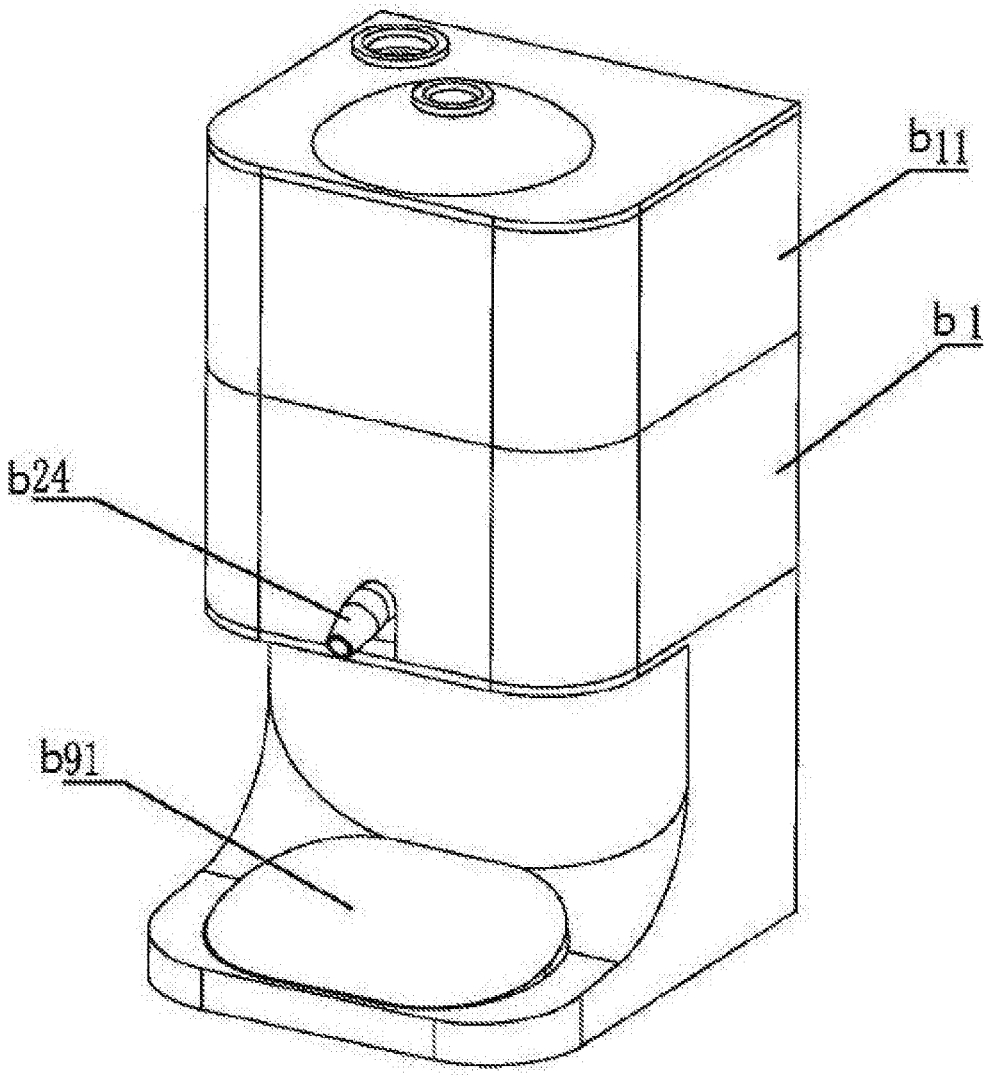
FIG. 13 is a schematic view of an appearance of a soap dispenser of embodiment 2.
Figure 14:
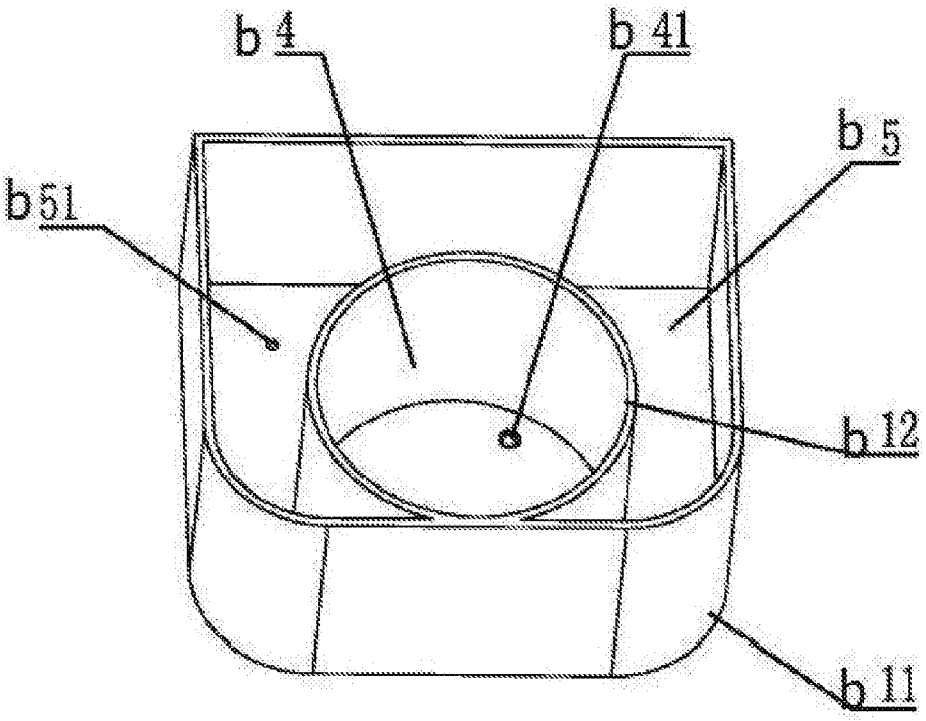
FIG. 14 is a schematic view of a tank in embodiment 2.
Figure 15:
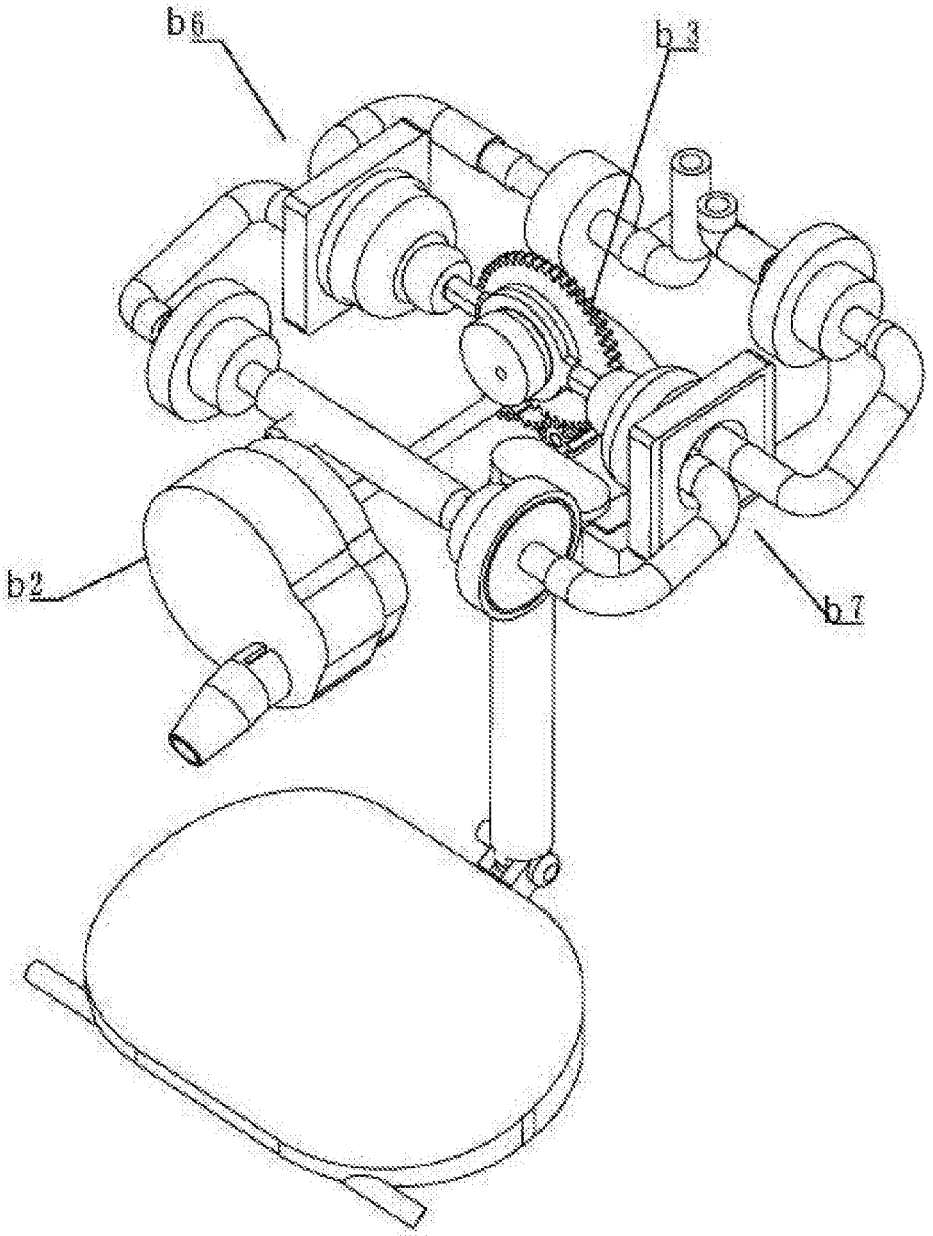
FIG. 15 is a schematic view of an interior of the tank in embodiment 2.

Referring to FIGS. 13 to 15, a dual-path foam soap dispenser is provided, including a housing b1 having a liquid soap outlet. The housing b1 is internally provided with a foaming device b2, a drive device b3, a raw material chamber b4, and a water chamber b5. Moreover, the water chamber b5 is provided with a water outlet b51. The raw material chamber b4 is provided with a discharge port b41. The foaming device b2 is provided with an inlet. The inlet of the foaming device b2 is connected to the water outlet b51 of the water chamber b5 through a pipe which is provided with the liquid dispensing and transmitting device b6. The inlet of the foaming device b2 is connected to the discharge port b41 of the raw material chamber through a pipe which is provided with the raw material dispensing and transmitting device b7. The raw material dispensing and transmitting device b6 has two functions, one of which is to draw in the raw material from the raw material chamber b4 to the foaming device b2, actively, so that there is a sufficient power for even the viscous or paste-like raw material; the other is to adjust the flow rate of the pumped raw materials. The liquid dispensing and transmitting device b6 also has two functions: one of which is to draw in the liquid water from the water chamber b5, actively; and the other is to adjust the flow rate of the pumped water. With the interaction between the raw material dispensing and transmitting device b7 and the liquid dispensing and transmitting device b6, the flow rate of both water and raw material is controllable. The user can choose different flow rates flowing into the foaming device b2 according to actual demands. If the raw material is paste-like or thick, the flow rate of the raw material is properly reduced, and the flow rate of water is increased, such that the materials entering the foaming device b2 have a low concentration after mixed, which can be foamed easily. Whereas, if the raw materials have a low concentration initially, the flow rate of the raw material is properly increased, and the flow rate of water is reduced, or even no water inflow.

After the above-mentioned mixing and foaming, the foam soap is discharged from an outlet of the foaming device b2 to the liquid soap outlet for the user to use.

In addition, both the raw material dispensing and transmitting device b7 and the foaming device b2 in embodiment 2 need to be actuated by external force to realized relative functions. One drive device b3 serves as power source of this external force simultaneously, such that the space occupation of the entire soap dispenser can be greatly saved, and it is suitable for more applications.

The soap dispenser of embodiment 2 not only can process a liquid raw material having a low concentration, but also can use a viscous raw material having a relatively high concentration to produce foam. Moreover, even a paste-like raw material is acceptable, such that the restrictions of raw material in the existing soap dispenser are reduced, and it is more suitable for people to use.

Referring to FIGS. 13 and 14, the tank b11 is arranged at a top of the housing b1. A middle portion of the tank b11 is provided with an annular wall a12 which divides the tank into a cylindrical raw material chamber b4 enclosed by the annular wall, and a water chamber b5 outside the annular wall. A bottom of the tank b11 is provided with two holes, one of which is connected to the raw material chamber b4 and serves as a discharge port b41 of the raw material chamber b4, and the other is connected to the water chamber b5 and serves as the water outlet b51 of the water chamber b5. Generally, the raw material chamber b4 is filled with raw materials for washing, while the water chamber b5 is alternatively filled with water, according to demands.

As a further preferred embodiment, the drive device b3 is connected to the liquid dispensing and transmitting device b6 and serves as power source for the liquid dispensing and transmitting device b6. That is to say, the drive device b3 serves as power source for the liquid dispensing and transmitting device b6, the raw material dispensing and transmitting device b7, and the foaming device b2, simultaneously, such that space occupation of the entire soap dispenser is further saved.

Figure 16:
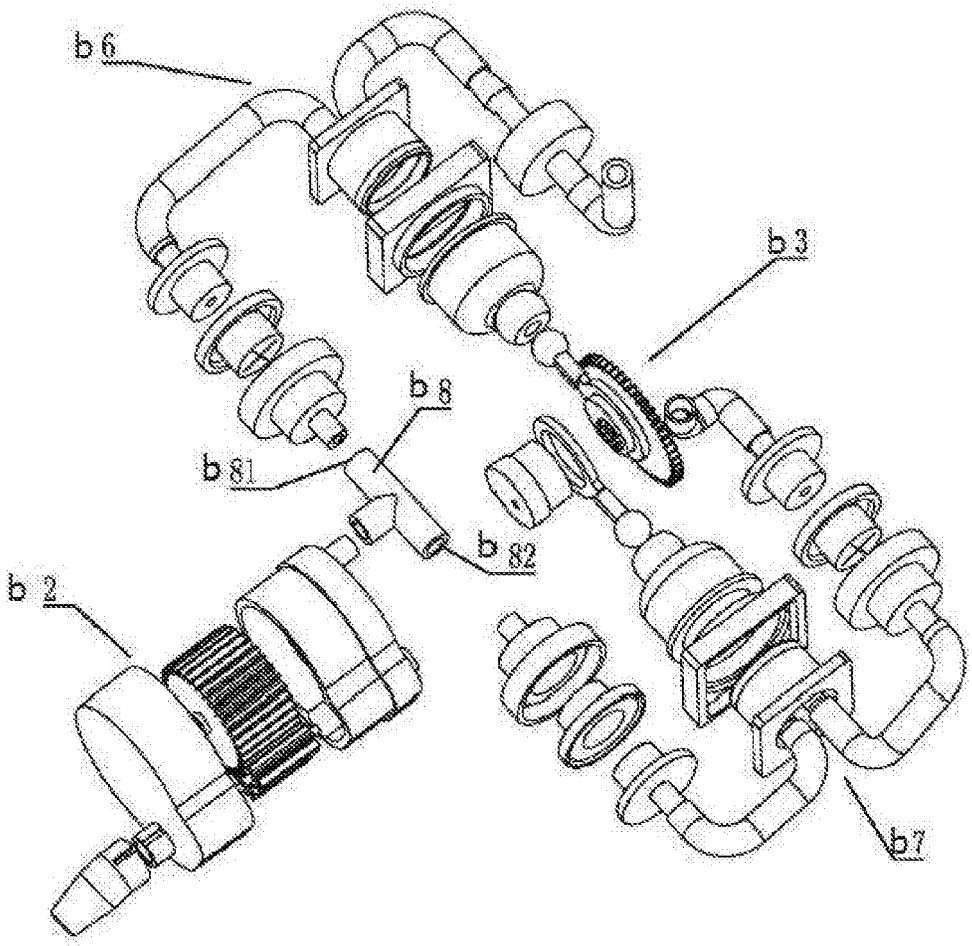
FIG. 16 is an exploded view of a foaming device, a raw material dispensing and transmitting device, and a liquid dispensing and transmitting device in embodiment 2.
Figure 17:
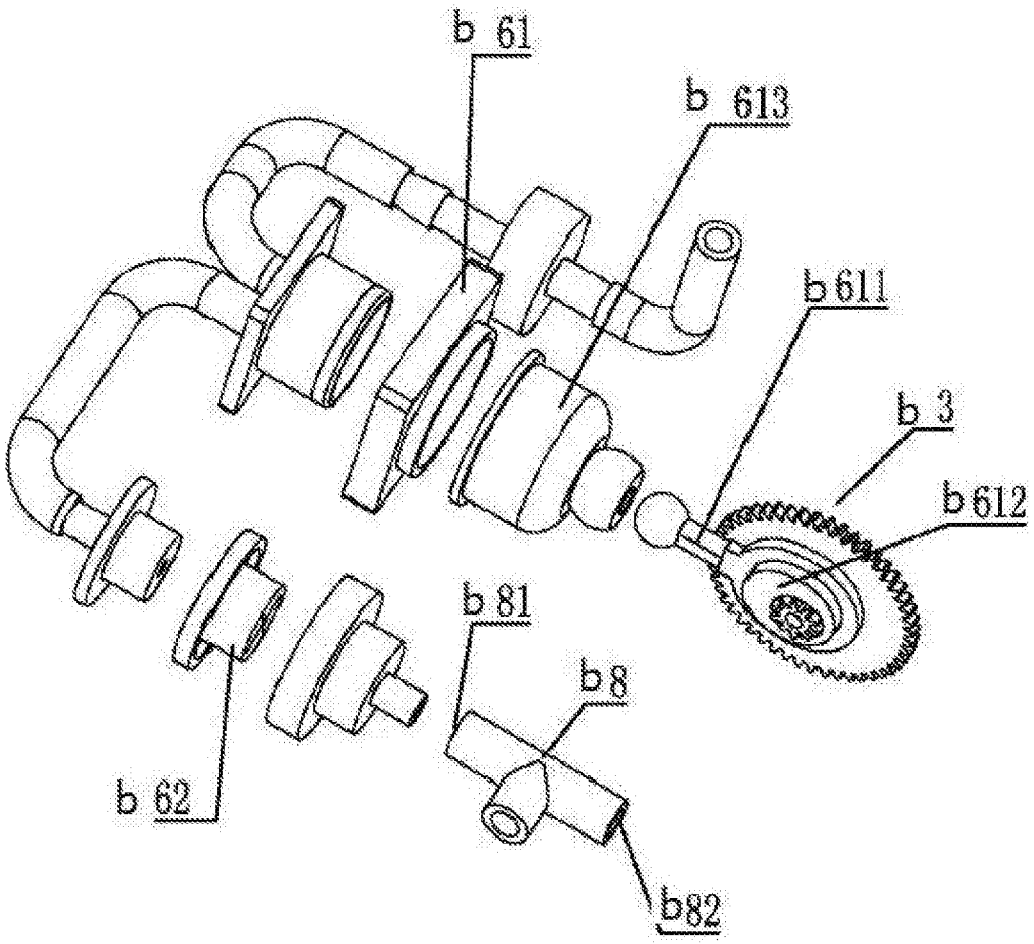
FIG. 17 is a schematic view of the liquid dispensing and transmitting device in embodiment 2.
Figure 18:
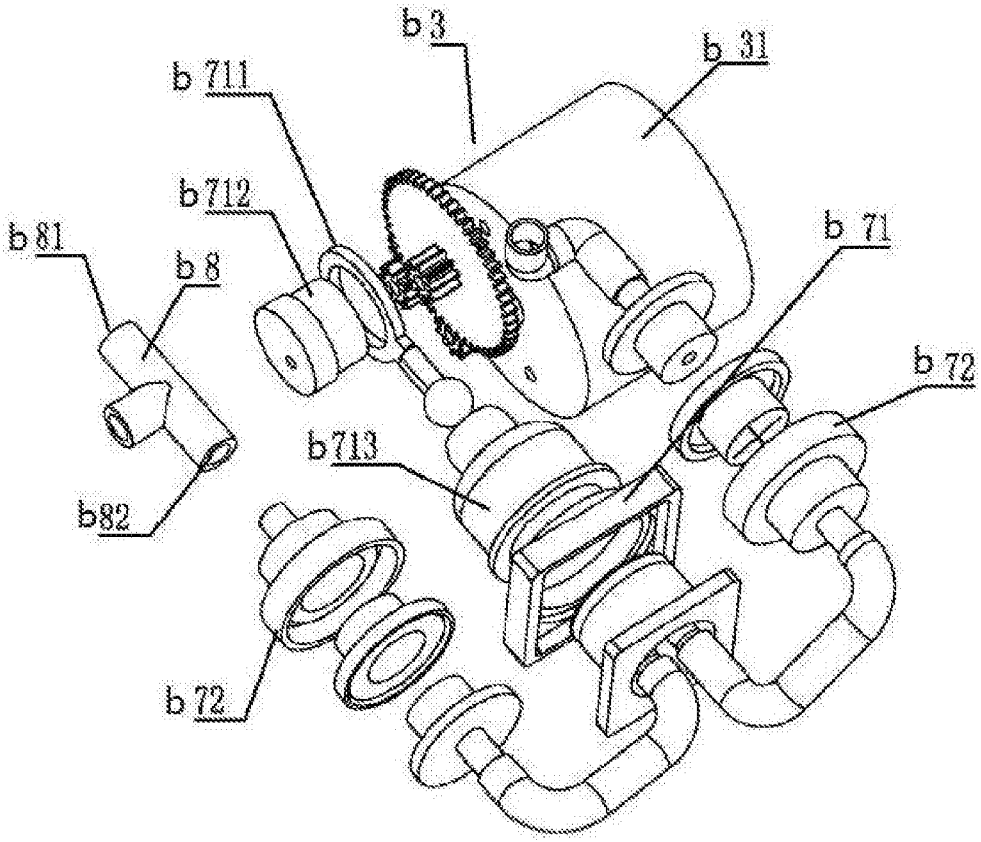
FIG. 18 is a schematic view of the raw material dispensing and transmitting device in embodiment 2.

Referring to FIGS. 16 to 18, the raw material and water may be mixed at first, before entering the foaming device b2, for the above purpose a mixing pipe b8 is arranged on the inlet of the foaming device b2. The mixing pipe b8 is provided with a liquid inlet b81 connected to the liquid dispensing and transmitting device b6, and a feed port b82 connected to the raw material dispensing and transmitting device b7. A simple mixing pipe b8 is a tee tube. Apparently, the mixing pipe can be other types of pipes having other configurations as needed, as long as the liquid entering from the liquid inlet b81 is mixed with the raw material entering from feed port b82 in the mixing pipe b8 at first, before entering the inlet of the foaming device b2.

The raw material dispensing and transmitting device b7 is described hereinafter.

Referring to FIG. 18, the raw material dispensing and transmitting device b7 includes a material-pumping pressure pump b71. The material-pumping pressure pump b71 includes an elastic cup b713, and a first connecting rod b711 which reciprocates to actuate the elastic cup b713. The first connecting rod b711 is connected to the elastic cup b713. The reciprocating translation of the first connecting rod can actuate the elastic cup to carry out an "inhale-exhale" movement. When in the "inhale" state, the elastic cup and the material-pumping pressure pump b71 draw in the material, and when in the "exhale" state, the elastic cup and the material-pumping pressure pump b71 discharge the material.

In embodiment 2, the raw material dispensing and transmitting device b7 further includes a material shutoff valve b72 arranged on inlet and outlet pipes of the material-pumping pressure pump b71. When the material-pumping pressure pump b71 is operating, and the material shutoff valve b72 forms a passageway. When the material-pumping pressure pump b71 is stopped, the material shutoff valve b72 is automatically closed.

Figure 19:
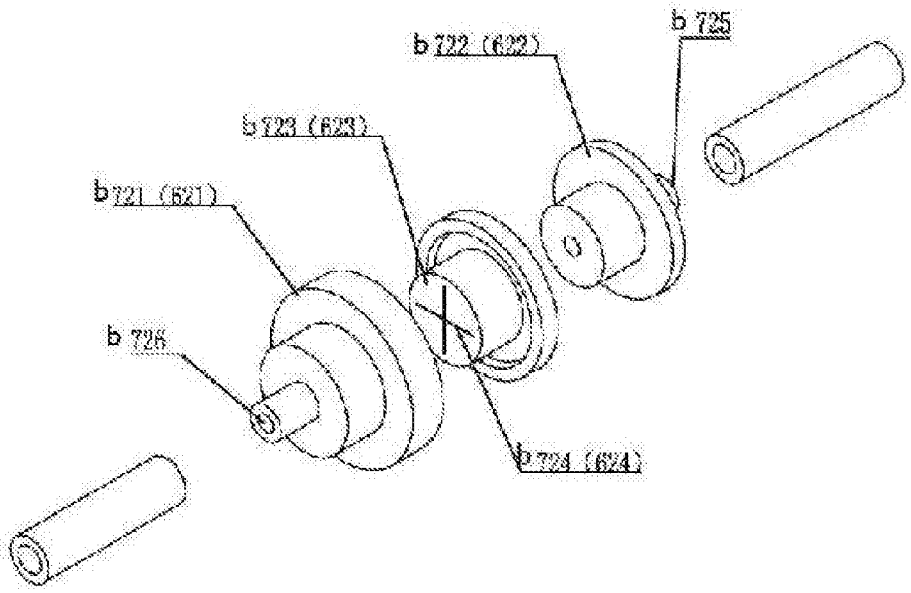
FIG. 19 is an exploded view of a material shutoff valve and a water shutoff valve in embodiment 2.

Referring to FIG. 19, the material shutoff valve b72 includes a valve housing b721, an inner housing b722 fitted within the valve housing b721, and an elastic sheet b723 (silicone sheet) held between the valve housing b721 and the inner housing b722. The valve housing b721 is provided with a valve outlet b726, the inner housing b722 is provided with a valve inlet b725, and a water flowing passage is formed between the valve inlet b725 and the valve outlet b726. A part of held portion of the elastic sheet a723 blocks the flowing passage. The blocking part is provided with a cross-shaped opening slit b724 penetrating the entire elastic piece b723, such that the blocking part is divided into four retractable elastic valves. If the material-pumping pressure pump b71 is operating, the raw material is formed with a certain pressure, and the pressurized material will crash and open the elastic valves, so that the raw material can flow through the water shutoff valve b72. However, if the material-pumping pressure pump b71 is not operating, the material will not have a pressure or the pressurized material is too weak to neutralize the elastic force of the elastic valves and open the elastic valves, such that the raw material will be blocked by the elastic valves and unable to pass through the water shutoff valve b72. This type of material shutoff valve b72 allows material to flow over the valve selectively, thus, there is no need for manual opening and closing, which will bring a great convenience to the users.

The liquid dispensing and transmitting device b6 will be described hereinafter.

Referring to FIG. 17, the liquid dispensing and transmitting device b6 includes a liquid-pumping pressure pump b61. The structure of the liquid-pumping pressure pump b61 is similar to that of the material-pumping pressure pump b71, which also has an elastic cup b613 and a second connecting rod b611 which reciprocates to actuate the elastic cup to carry out the "inhale-exhale" operation, thus the details will not be repeated herein.

In addition, the liquid dispensing and transmitting device b6 further includes a one-way valve and a water shutoff valve b62. The one-way valve is arranged between an inlet of the liquid-pumping pressure pump b61 and the water chamber b5 to prevent water from flowing back into the water chamber b5 during the pumping process. The water shutoff valve b62 is arranged on an outlet pipe of the liquid-pumping pressure pump b61. When the liquid-pumping pressure pump b61 is operating, the water shutoff valve b62 forms a passageway. When the liquid pumping pressure pump b61 is stopped, the water shutoff valve b62 is automatically closed. The water shutoff valve b62 and the material shutoff valve b72 in the embodiment have the same structure. The water shutoff valve also has a valve housing b621, an inner housing b622, an elastic sheet b623, and an opening slit b624, and the connections therebetween are also the same as those of the material shutoff valve, thus the details will not be repeated herein.

The foaming device b2 is described hereinafter.

Figure 20:
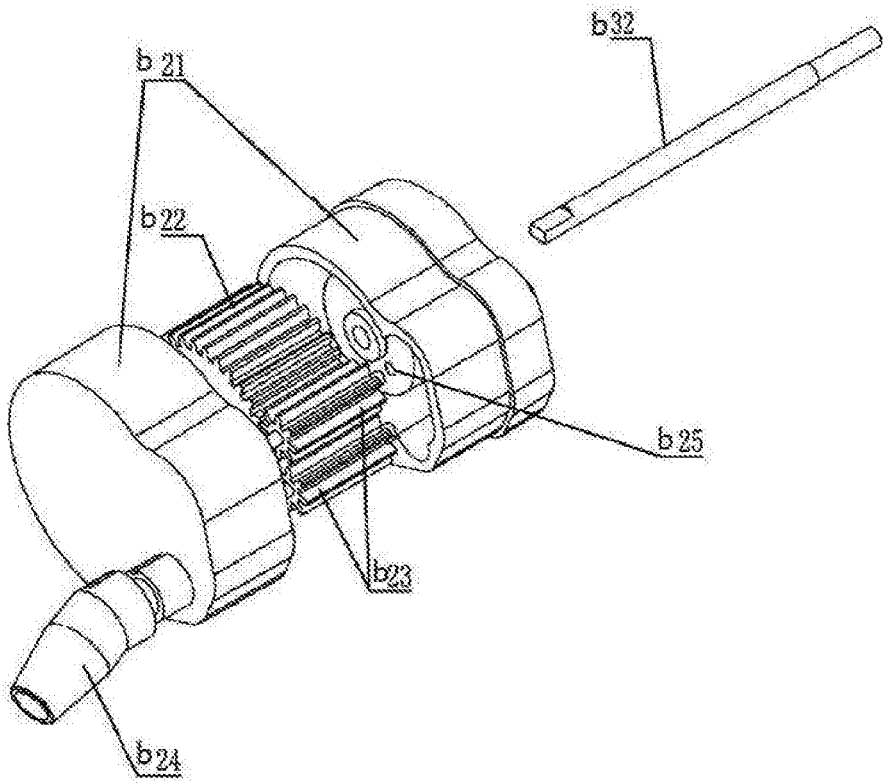
FIG. 20 is a structural schematic view of a foaming device in embodiment 2.
Figure 21:
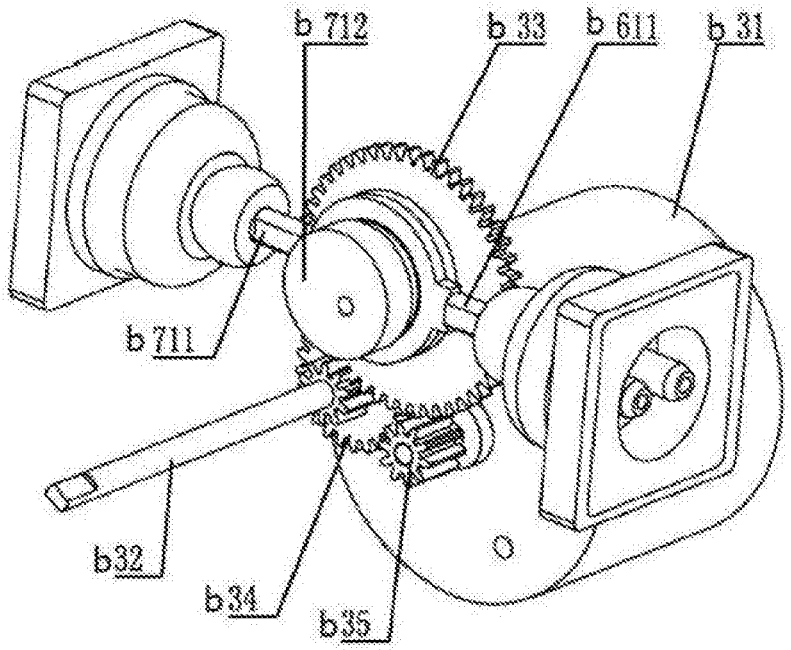
FIG. 21 is a schematic diagram of a drive device in embodiment 2.

Referring to FIG. 20, the foaming device b2 in embodiment 2 includes a foaming housing b21. A cavity inside the foaming housing b21 is provided with a foam-rubbing gear mechanism. The foam-rubbing gear mechanism includes a main gear b22 and two pinions b23, all of which constitute gear pairs. One side wall of the foaming device b21 is provided with an inlet of the foaming device b2. An opposite side wall of the foaming housing is provided with a spray nozzle b24 which serves as the liquid soap outlet for the entire soap dispenser. The foaming housing b21 is further provided with an air inlet b25. Air inlet b25 is used to draw in air. When the main gear b22 engaging with two pinions b23 is rotating, the mixture entering the foaming housing b21 is mixed and grinded with the indrawn air, so as to discharge the foam soap.

The drive device b3 and the drive mode thereof will be described hereinafter.

Referring to FIGS. 16, 17, 18 and 21, the drive device b3 in embodiment 2 includes a power rotary shaft (not shown), a drive shaft b32, a drive motor b31, a first gear b33, a second gear b34, and a third gear b35. The drive motor b31 serves as total power source of the entire drive device b3.

An output terminal of the drive motor b31 is externally connected to the third gear b35. The third gear b35 is externally engaged with the second gear b34. The second gear b34 is a gear set, substantially, which is externally engaged with the first gear b33, so that the rotation of both the second gear b34 and the first gear b33 is directly actuated by the drive motor b31. The drive shaft b32 is connected to the second gear b34. Moreover, an end of the drive shaft b32 extends into the foaming housing b21 to connect with one of the main gear b22 or the pinions b23, so as to provide power to the foam-rubbing gear mechanism. The power rotary shaft is located in the first gear b33 and parallel to the drive shaft b32. The power shaft is provided with the first eccentric b712 and the second eccentric b612. Moreover, an end of the first connecting rod b711 is connected to a peripheral surface of the first eccentric b712. When the first eccentric b712 is actuated by the power rotary shaft to rotate, the first connecting rod b711 will reciprocate, so as to actuate the pumping of the material-pumping pressure pump b71. Designers or users can design the first eccentric b712 with different eccentric distances to adjust the pumping capacity of the material-pumping pressure pump b71. In addition, an end of the second connecting rod b611 is connected to a peripheral surface of the second eccentric b612. When the second eccentric b612 is actuated by the power rotary shaft to rotate, the second connecting rod b611 will reciprocate, so as to actuate the pumping of the liquid-pumping pressure pump b61. Designers or users can design second eccentric b612 with different eccentric distances to adjust the pumping capacity of the liquid-pumping pressure pump b61.

To conclude, the drive device b3 actuates the liquid-pumping pressure pump b61, the material-pumping pressure pump b71, and the foaming device b2, simultaneously. Moreover, since the liquid-pumping pressure pump b61 and material-pumping pressure pump b71 operate at the same time, there is no time difference for the water and raw material to enter the mixing pipe b8.

As a further improvement of embodiment 2, a trigger device electrically connected to the drive device b3 is further included. The trigger device includes a pressing plate b91, a trigger connecting rod b92, a trigger switch b93, and a linkage plate b94. One end of the pressing plate b91 is laterally hinged to a bottom of the housing b1. The other end of the pressing plate is a free end. The trigger connecting rod b92 is vertically arranged. A bottom end of the trigger connecting rod b92 is connected to the free end, and a top end thereof is fixed to the linkage plate b94. The trigger switch b93 is located above the pressing plate b91 and fixed to the housing b1. The trigger switch b93 is located in the vertical translation path of the linkage plate b94.

Figure 22:
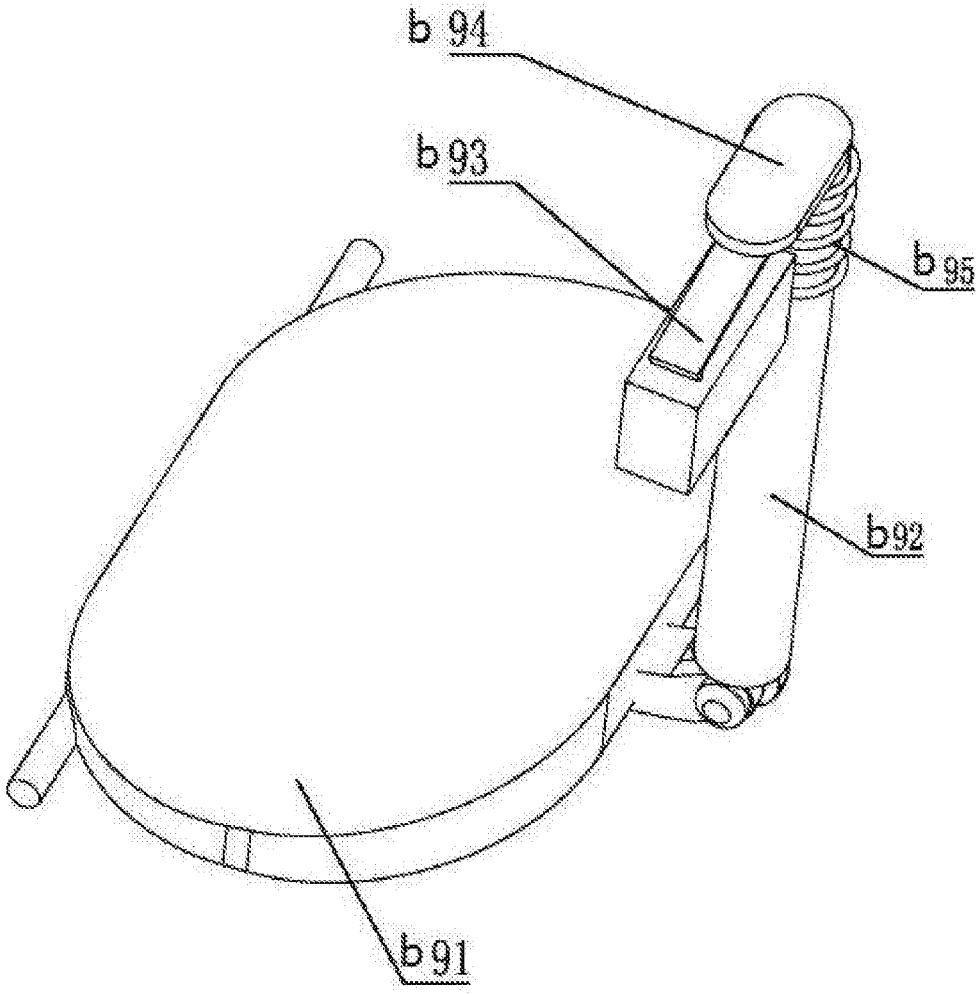
FIG. 22 is a schematic diagram of a trigger device in embodiment 2.

Referring to FIGS. 13 and 22, the soap dispenser further includes a trigger device electrically connected to the drive motor b31 to provide the user a simple switch on-off of the drive motor. The trigger device includes the pressing plate b91, the trigger connecting rod b92, the trigger switch b93, and the linkage plate b94. A main body of the pressing plate b91 is exposed outside the housing b1 for easy operation. One end of the pressing plate b91 is laterally hinged to the bottom of the housing b1. The other end of the pressing plate is a free end which can be pressed. The trigger connecting rod b92 is vertically arranged perpendicular to the hinge shaft of the pressing plate b91. The bottom end of the trigger connecting rod b92 is connected to the free end, and the top end thereof is fixed to the linkage plate b94. The trigger switch b93 is a press-button switch located above the pressing plate b91 and fixed to the housing b1. The trigger switch b93 is located in the vertical translation path of the linkage plate b94. When the user presses or steps the pressing plate b91, the linkage plate b94 descends along the vertical direction subsequently as the trigger connecting rod b92 descends immediately. The trigger switch b93 is triggered during the descending process. Thereafter, the drive motor b31 and drive device b3 are actuated. In order to make the trigger connecting rod b92 translate to a reset position upwardly after releasing the pressing plate b91, a periphery of the trigger connecting rod b92 sheathed at a lower end surface of the linkage plate b94 is provided with a reset spring b95, and a bottom end of the reset spring b95 is connected to the housing b1.

The brief operation of the embodiment 2 is as follows.

When the trigger device is triggered, the drive device b3 actuates the liquid dispensing and transmitting device b6, the raw material dispensing and transmitting device b7, and the foaming device b2, simultaneously. The water is transmitted to the mixing pipe b8 by the liquid dispensing and transmitting device b6 at a proportion and the raw material is transmitted to the mixing pipe b8 raw material dispensing and transmitting device b7 at a proportion. After a mixture of the water and raw material, the raw material is diluted to mix with water sufficiently. The mixture enters the foaming device b2 to produce foam, subsequently. Finally, the foam soap is discharged from the soap dispenser via the spray nozzle b24.

Embodiment 3

As shown in FIGS. 23 to 31, an efficient multi-functional foam soap dispenser includes a housing c1 provided with a liquid soap outlet. The housing c1 is internally provided with a mixing device c2, a foaming device c4, a drive-pumping device c3, a raw material chamber c5, and a water chamber c6. The mixing device c2 includes a feed port connected to a discharge port of the raw material chamber c5, a water inlet connected to a water outlet of the water chamber c6, and a discharge port connected to an inlet of the foaming device c4. The liquid soap outlet is connected to the foaming device c4. The drive-pumping device c3 is connected to the mixing device c2 and the foaming device c4, and serves as power source for the mixing device c2 and the foaming device c4, simultaneously. The mixing device c2 includes a mixing-diluting-transmitting housing c21 and a mixing vessel c24 arranged on an upper portion of the mixing-diluting-transmitting housing c21. A side of the housing body of the mixing-diluting-transmitting housing c21 is provided with an opening to form a transmitting chamber c25 inside the mixing-diluting-transmitting housing body. The transmitting chamber c25 is internally provided with a mixing straight gear c26. The mixing vessel c24 is provided with a mixing crown gear c23. A bottom of the mixing vessel c24 is further provided with a mixing port c213 connected to the transmitting chamber c25. An upper portion of the mixing crown gear c23 is provided with a stirring pieces c27. A center position of the mixing vessel c24 is provided with a crown gear fixing cotter c214 for fixing the mixing crown gear c23. A space between an outer rim of the crown gear fixing cotter c214 and an inner rim of the mixing vessel c24 forms a mixing groove c212. A lower portion of the mixing crown gear c23 and the mixing straight gear c26 are engaged with each other in the mixing port c213 of a mixing groove c212. The mixing port c213 is arranged at the engaging point of the mixing crown gear c23 and the mixing straight gear c26.

In embodiment 3, a transmitting chamber opening of the mixing-diluting-transmitting housing c21 is provided with a transmitting chamber cover c22 for covering the transmitting chamber c25. A center of the transmitting chamber cover c22 is sheathed around a rotary shaft connected to the mixing straight gear c26. Moreover, the mixing straight gear c26 is covered inside the transmitting chamber c25 by means of the transmitting chamber cover.

In embodiment 3, an upper portion of a side adjacent to a transmitting chamber opening side of the mixing-diluting-transmitting housing c21 is provided with a water inlet c29 connected to the water chamber. The water inlet c29 is connected to the mixing groove c212.

In embodiment 3, a lower portion of the mixing-diluting-transmitting housing c21 is further provided with a first mixed liquid outlet c210, and a second mixed liquid outlet c211. The first mixed liquid outlet c210 is connected to the transmitting chamber c25. The first mixed liquid outlet c210 is connected to the second mixed liquid outlet c211.

In embodiment 3, a side opposite to a transmitting chamber opening side of the mixing-diluting-transmitting housing c21 is provided with a third mixed liquid outlet c28. The third mixed liquid outlet c28 is connected to the second mixed liquid outlet c211. The third mixed liquid outlet c28 is further connected to a liquid inlet of the foaming device c4.

The operation principle of the mixing device c2 is as follows: the mixing straight gear c26 is a power gear actuated by the drive-pumping device c3. When the mixing straight gear is not actuated, a passageway communicated with the raw material chamber c5 above the gear is filled with viscous washing materials which have a poor fluidity. When the drive-pump device c3 is operating, the washing material is actuated by the mixing straight gear c26 and uniformly pumped into the mixing vessel c24. At the same time, the mixing crown gear c23 is actuated by the mixing straight gear c26 to rotate, and the stirring pieces c27 located in the mixing crown gear c23 is actuated to rotate simultaneously during the rotation of the mixing crown gear c23. With the use of the stirring piece c27, the raw material is scraped into the mixing groove c212 easily. The pumping component c7 is actuated simultaneously to pump water toward the mixing vessel c24. The water and raw material are mixed at a proportion by the mixing groove c212. Subsequently, due to the action of gravity, the mixed liquid is fed to the transmitting chamber c25 through the mixing port c213. The mixing straight gear c26 and the mixing crown gear c23 are engaged with each other in the transmitting chamber c25 to mix the raw material with the water again. The mixing ratio of the mixture is controllable. For example, the mixing ratio can be controlled by adjusting the flow rate of the pumping component c7, or adjusting the modules, thickness, number of teeth, etc. of the mixing straight gear c26 and the mixing crown gear c23, as described above.

The mixing device c2, the foaming device c4, the drive-pumping device c3, the raw material chamber c5, and the water chamber c6 will be described in detail below.

Figure 23:
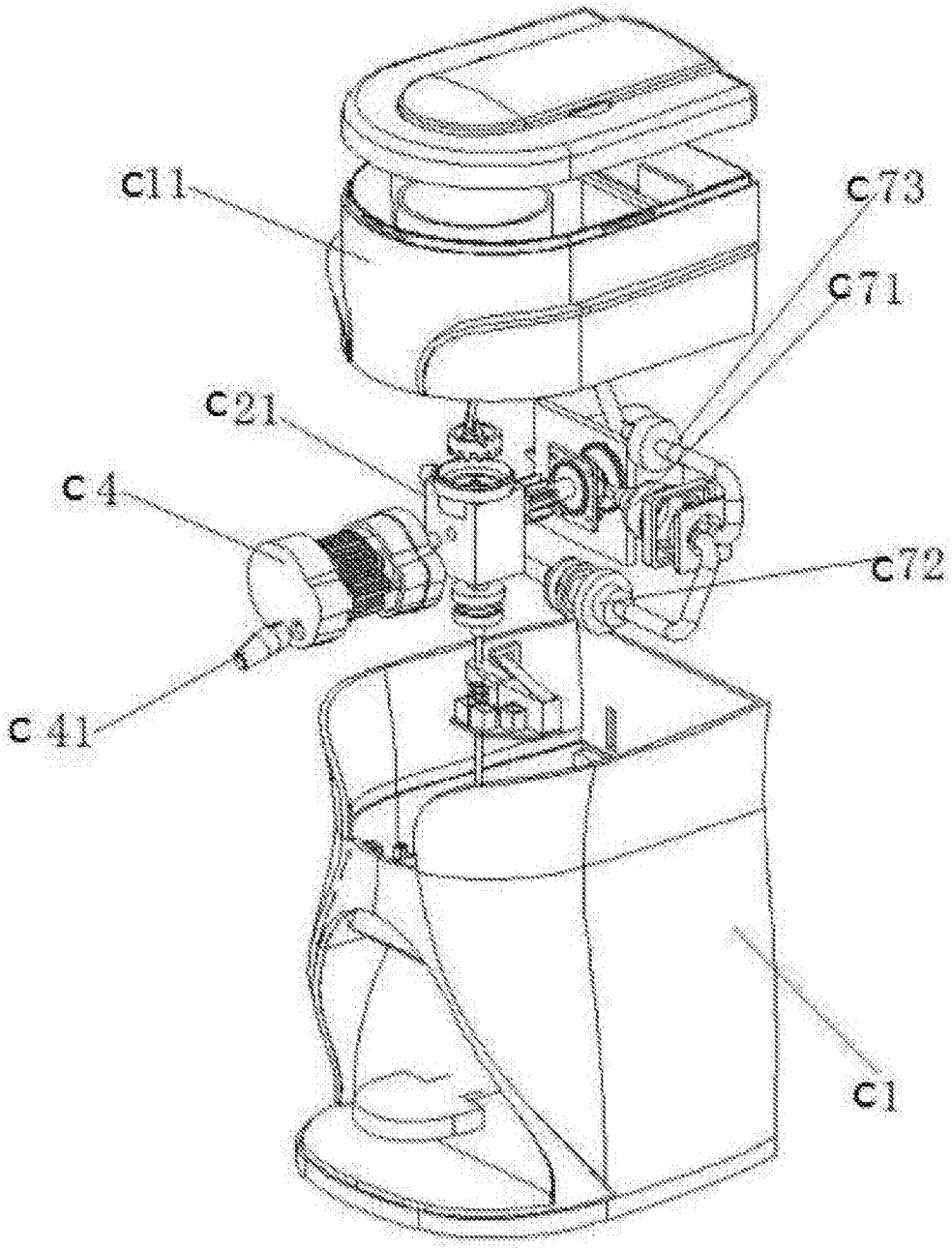
FIG. 23 is a schematic view of an appearance of the soap dispenser of embodiment 3.
Figure 32:
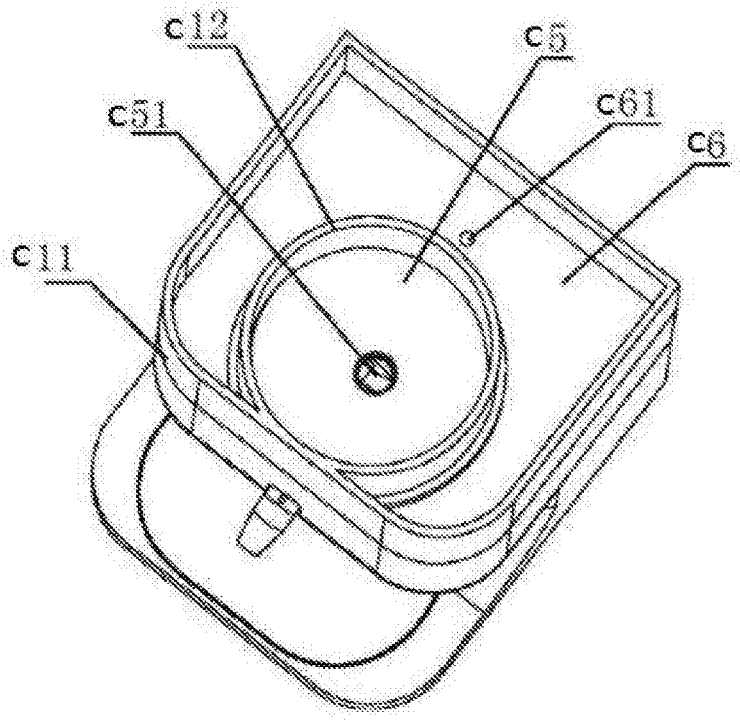
FIG. 32 is a structural schematic view of a top of the soap dispenser in embodiment 3.

Referring to FIGS. 23 and 32, a tank c11 is arranged at a top of the housing c1. A middle portion of the tank c11 is provided with an annular wall c12 which divides the tank into a cylindrical raw material chamber c5 enclosed by an annular wall, and a water chamber c6 outside the annular wall. A bottom of the tank c11 is provided with two holes, one of which is connected to the raw material chamber c5 and serves as a discharge port c51 of the raw material chamber c5, the other is connected to the water chamber c6 and serves as a water outlet c61 of the water chamber c6. Generally, the raw material chamber c5 is filled with raw materials for washing, while the water chamber c6 is alternatively filled with water, as needed. Specifically, if the raw material chamber c5 is filled with viscous or paste-like washing material, the water chamber a6 would be filled with water so that water and the viscous washing material enter the mixing device c2 to reduce the concentration of the washing material. If the raw material chamber c5 is filled with a washing raw material with low concentration, then the water chamber a6 can be empty.

In embodiment 3, the washing material is supplied to the mixing device c2 in the form of by gravity flow, namely, the feed port of the mixing device c2 is located below the raw material chamber c5. Since water has a high fluidity, and the flow rate is hard to control, the flow-adjustable pumping component c7 is thus arranged between the water outlet of the water chamber c6 and the water inlet of the mixing device c2. Water is pumped into the mixing device c2 only when the pumping component c7 is operating. Moreover, the water capacity pumped into the mixing device c2 can be controlled to a certain extent by controlling the pumping capacity of the pumping component c7, so as to adjust the concentration of the mixture.

The pumping component c7 needs to be actuated by external force. Preferably, the pumping component c7 is connected to the drive device c3 serving as power source, such that the space occupation of the soap dispenser is effectively saved. The pumping component c7 and the connection between the pumping component c7 and the drive device c3 will be described below.

Figure 33:
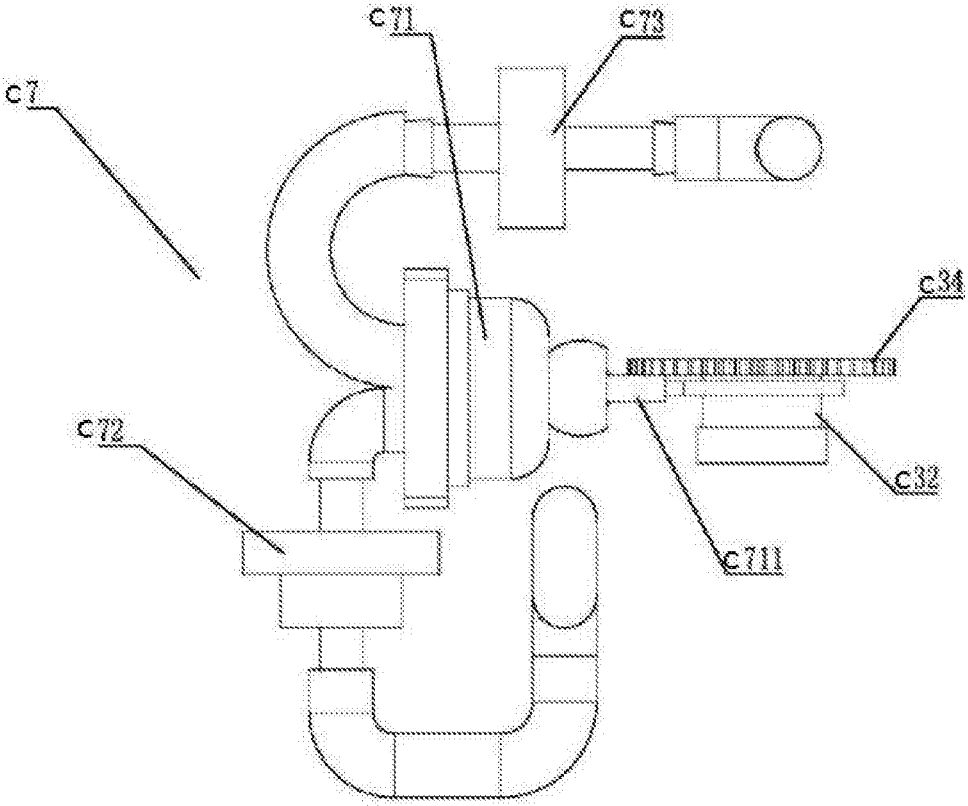
FIG. 33 is a structural schematic view of a pumping component of the soap dispenser in embodiment 3.

Referring to FIGS. 23 and 33, in embodiment 3, the pumping component c7 includes a pressure pump c71. The pressure pump c71 includes a connecting rod c711 which reciprocates to actuate a self-operation of pumping. A one-way valve c73 is arranged between an inlet of the pressure pump c71 and the water chamber c6 to prevent water from flowing back into the water chamber c6 during the pumping process. Moreover, a pipe that connects an outlet of the pressure pump c71 with the water inlet of the mixing device c2 is provided with a water shutoff valve c72. The water shutoff valve c72 is different from the one-way valve c73. When the pressure pump c71 is operating, the water shutoff valve c72 forms a passageway, and water can flow into the mixing vessel c24. However, when the pressure pump c71 is stopped, the water shutoff valve c72 is automatically closed to prevent water flow from flowing into the mixing vessel c24 under the action of gravity.

Figure 34:
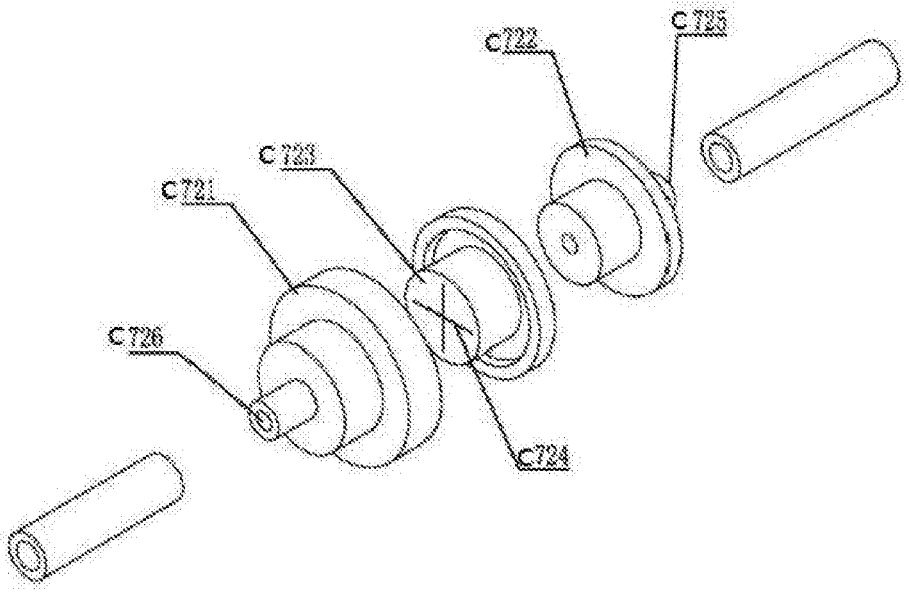
FIG. 34 is an exploded view of a water shutoff valve of the soap dispenser in embodiment 3.

Specifically, referring to FIG. 34, the water shutoff valve c72 includes a valve housing c721, an inner housing c722 fitted within the valve housing c721, and a cross-shaped elastic sheet c723 (silicone sheet) held between the valve housing c721 and the inner housing c722. The valve housing c721 is provided with a valve outlet c726, the inner housing c722 is provided with an valve inlet c725, and a water flowing passage is formed between the valve inlet c725 and the valve outlet c726. A part of held portion of cross-shaped elastic sheet c723 blocks the flowing passage. The blocking part is provided with a cross-shaped opening slit c724 penetrating the entire elastic sheet c723, such that the blocking part is divided into four retractable elastic valves. If the pressure pump c71 is operating, the water flow is formed with a certain pressure, and the pressurized water will crash and open the elastic valves, so that the water can flow through the water shutoff valve c72. However, if the pressure pump c71 is not operating, water flow will not have a pressure or the pressurized water is too weak to neutralize the elastic force of the elastic valves and open the elastic valves, such that the water flow will be blocked by the elastic valves and unable to pass through the water shutoff valve c72. This type of water shutoff valve allows water to flow over the valve selectively, thus, there is no need for manual opening and closing, which will bring a great convenience to users.

Figure 35:
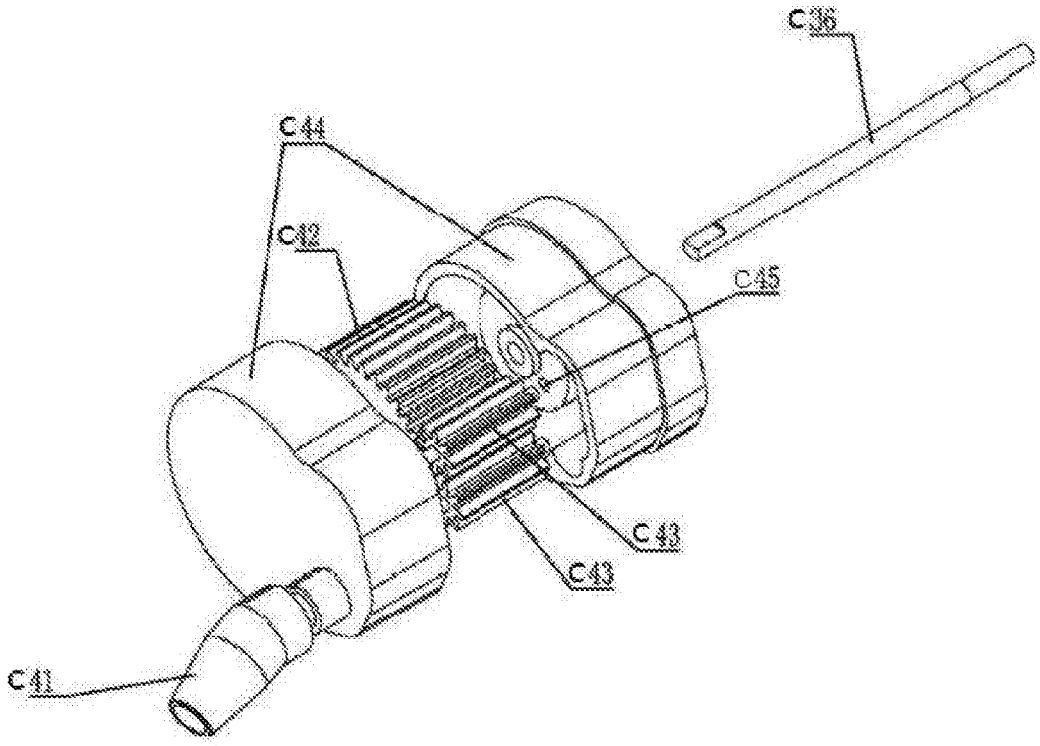
FIG. 35 is a structural schematic view of a foaming device of the soap dispenser in embodiment 3.
Figure 36:
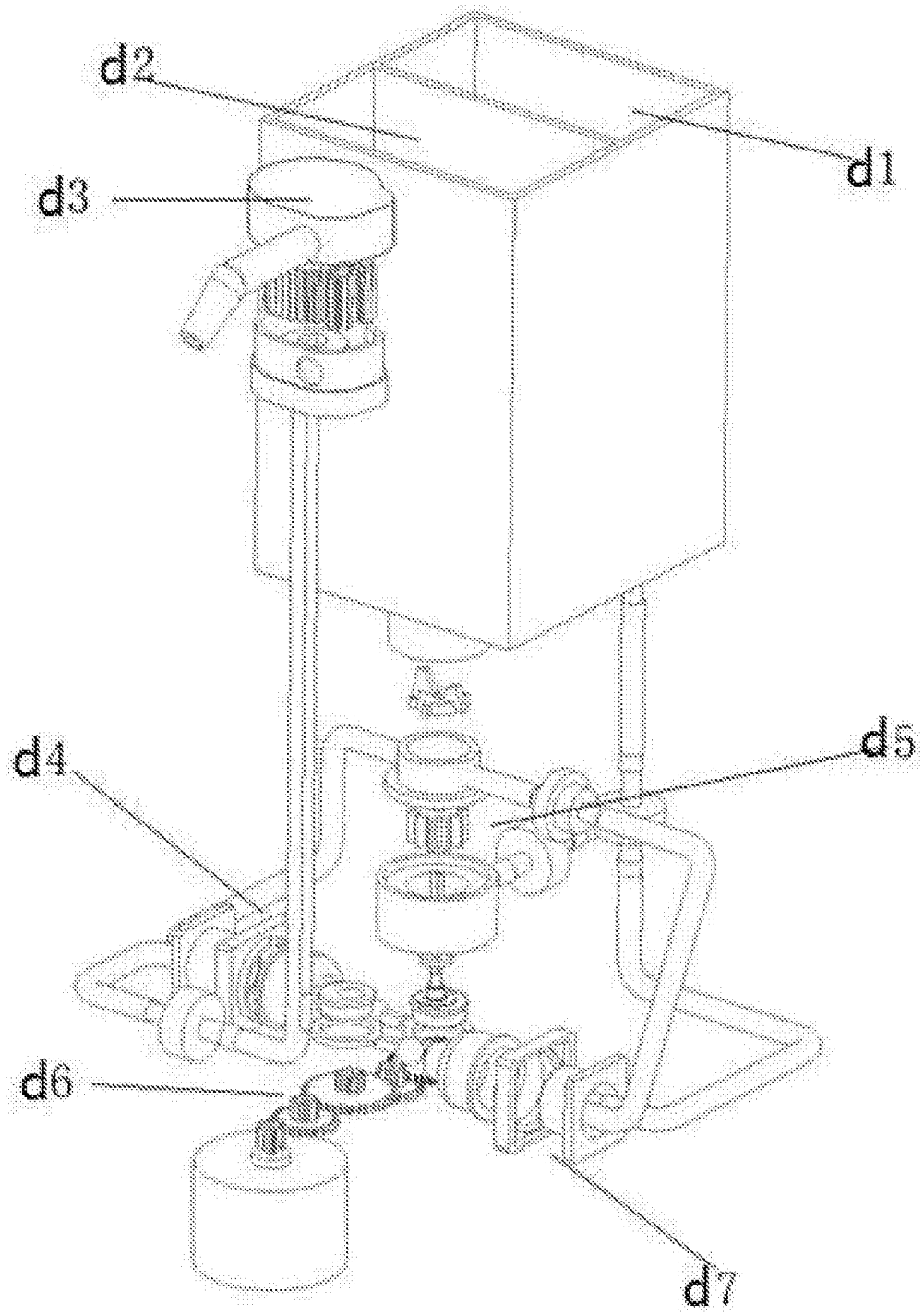
FIG. 36 is a structural schematic view of an entity in embodiment 4 of the present invention.
Figure 37:
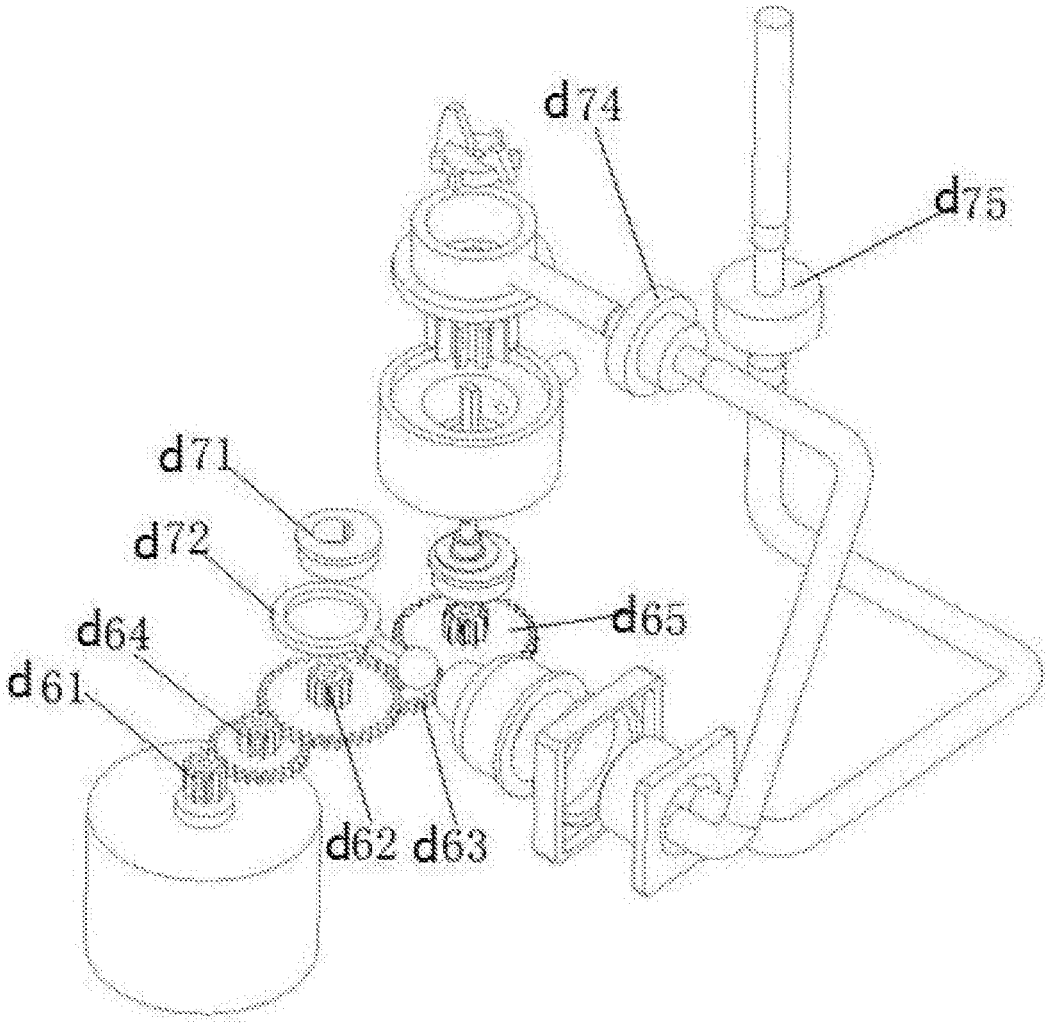
FIG. 37 is a structural schematic view of a liquid pumping-transmitting device in embodiment 4 of the present invention.
Figure 38:
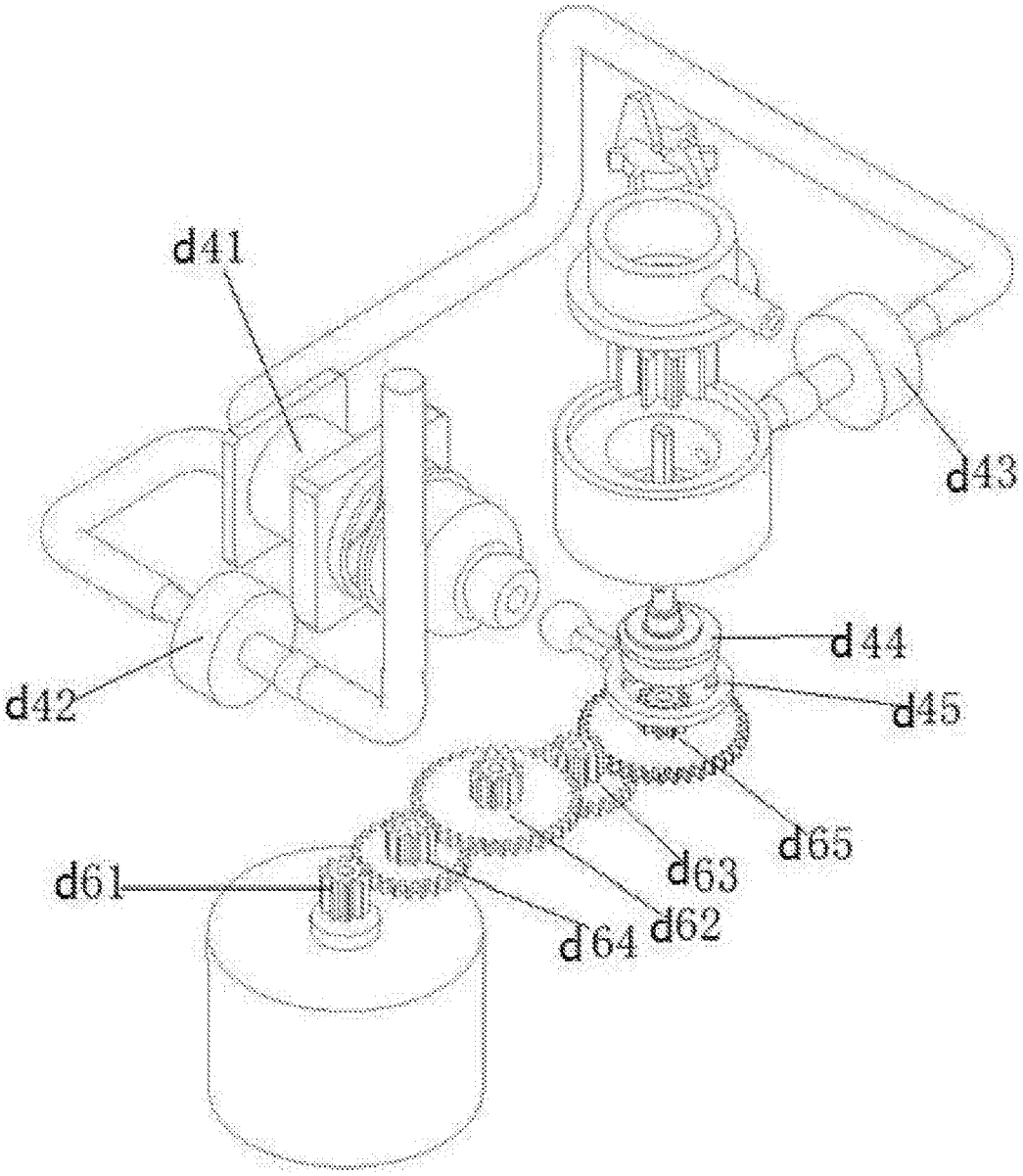
FIG. 38 is a structural schematic view of a mixed liquid pumping-transmitting device in embodiment 4 of the present invention.

Referring to FIG. 35, in embodiment 3, the foaming device c4 includes a foaming housing c44. The cavity inside the foaming housing c44 is provided with a foam-rubbing gear mechanism. The foam-rubbing gear mechanism includes a main gear c42 and two pinions c43, all of which constitute gear pairs. A side wall of the foaming housing c44 is provided with the inlet of foaming device c4. An opposite side wall is provided with a spray nozzle c41 serving as the liquid soap outlet, and the spray nozzle c41 is used as the liquid soap outlet for the entire soap dispenser. A drive shaft c36 of the drive-pumping device c3 is connected to and actuates one of the main gear c42 or the pinions c43. The foaming housing c44 is further provided with an air inlet c45. The air inlet c45 is used to draw in air. When the main gear c42 engaging with two pinions c43 is being rotated, the mixture entering foaming housing c44 is mixed and grinded with the pumped air to produce the foam soap.

Figure 24:
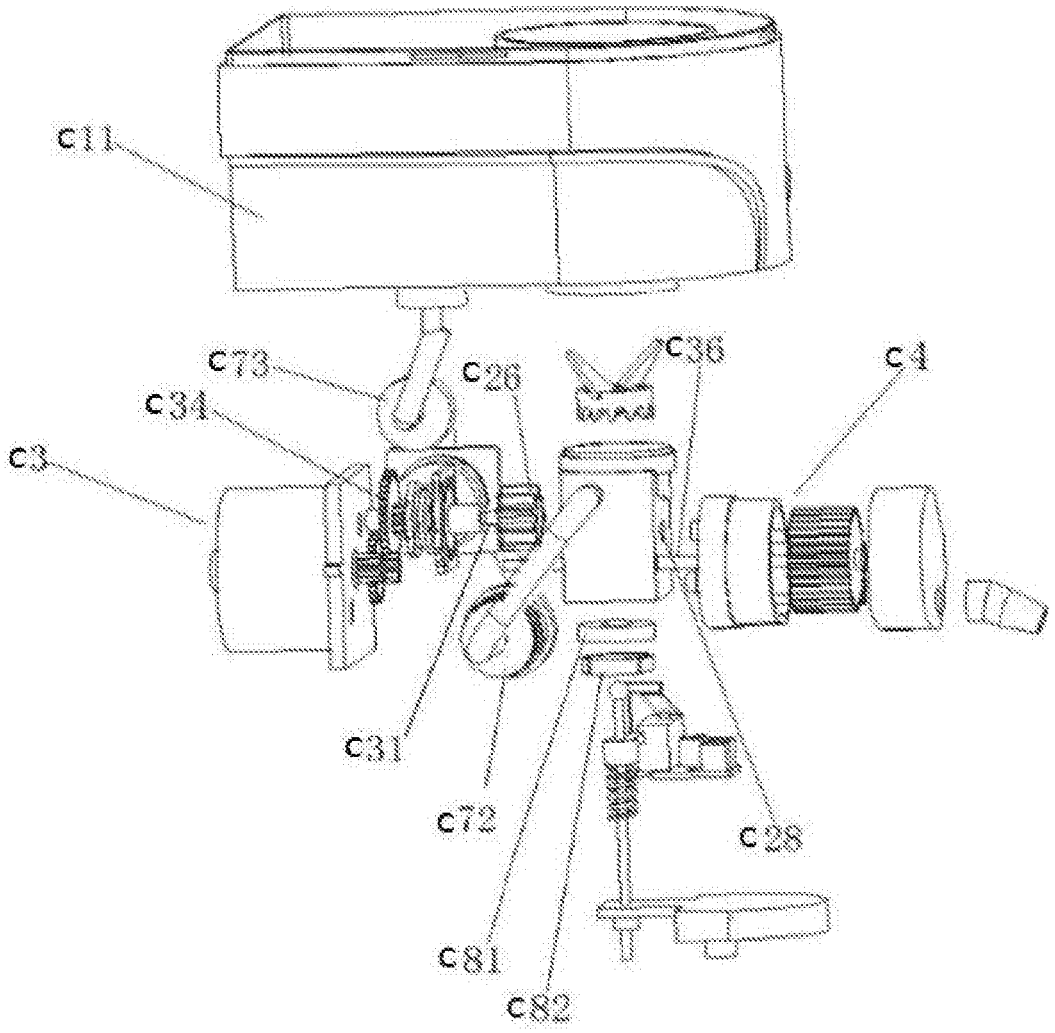
FIG. 24 is a structural schematic view of a connection of a trigger device, a foaming device, a mixing device, and a drive-pumping device in embodiment 3.
Figure 25:
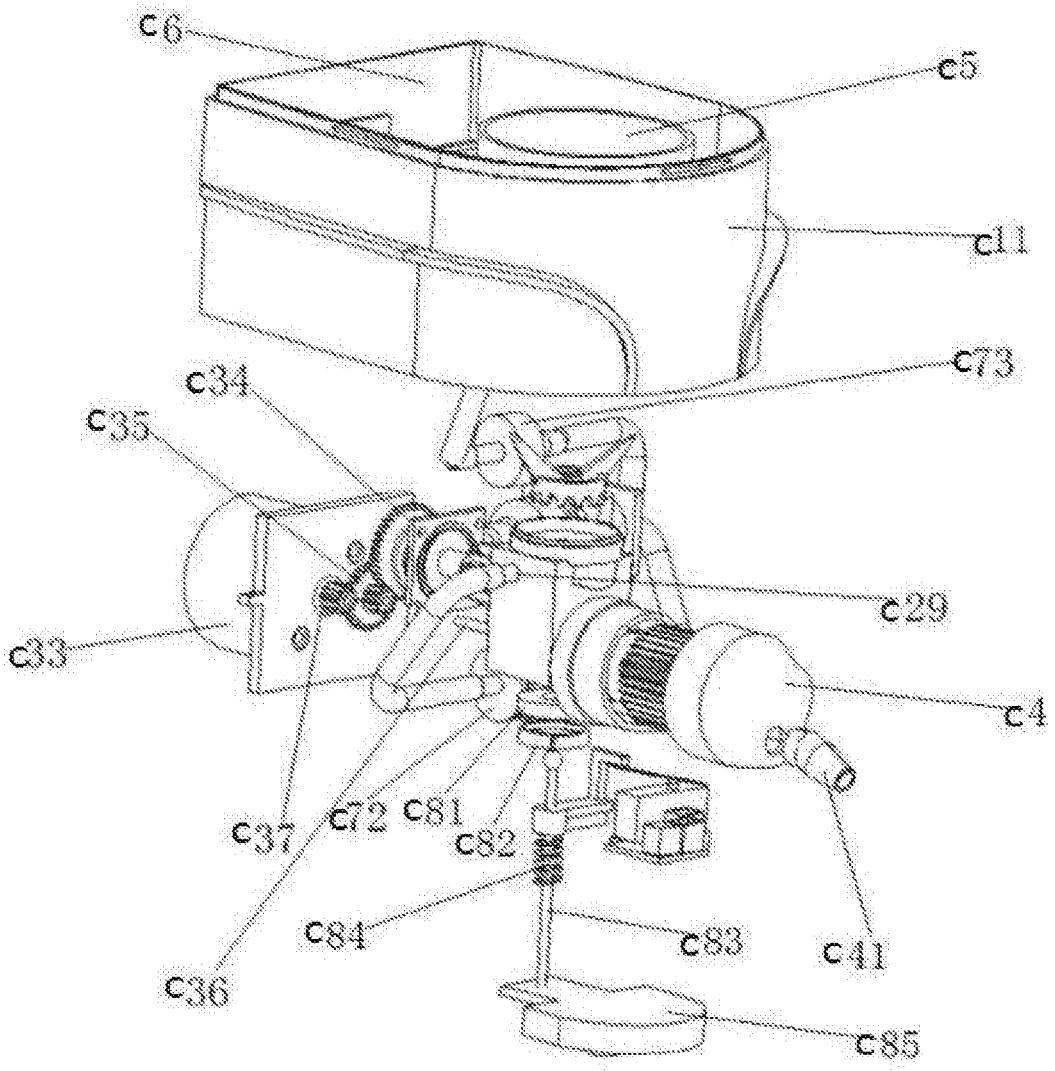
FIG. 25 is a structural schematic view of an interior of the soap dispenser in embodiment 3.
Figure 26:
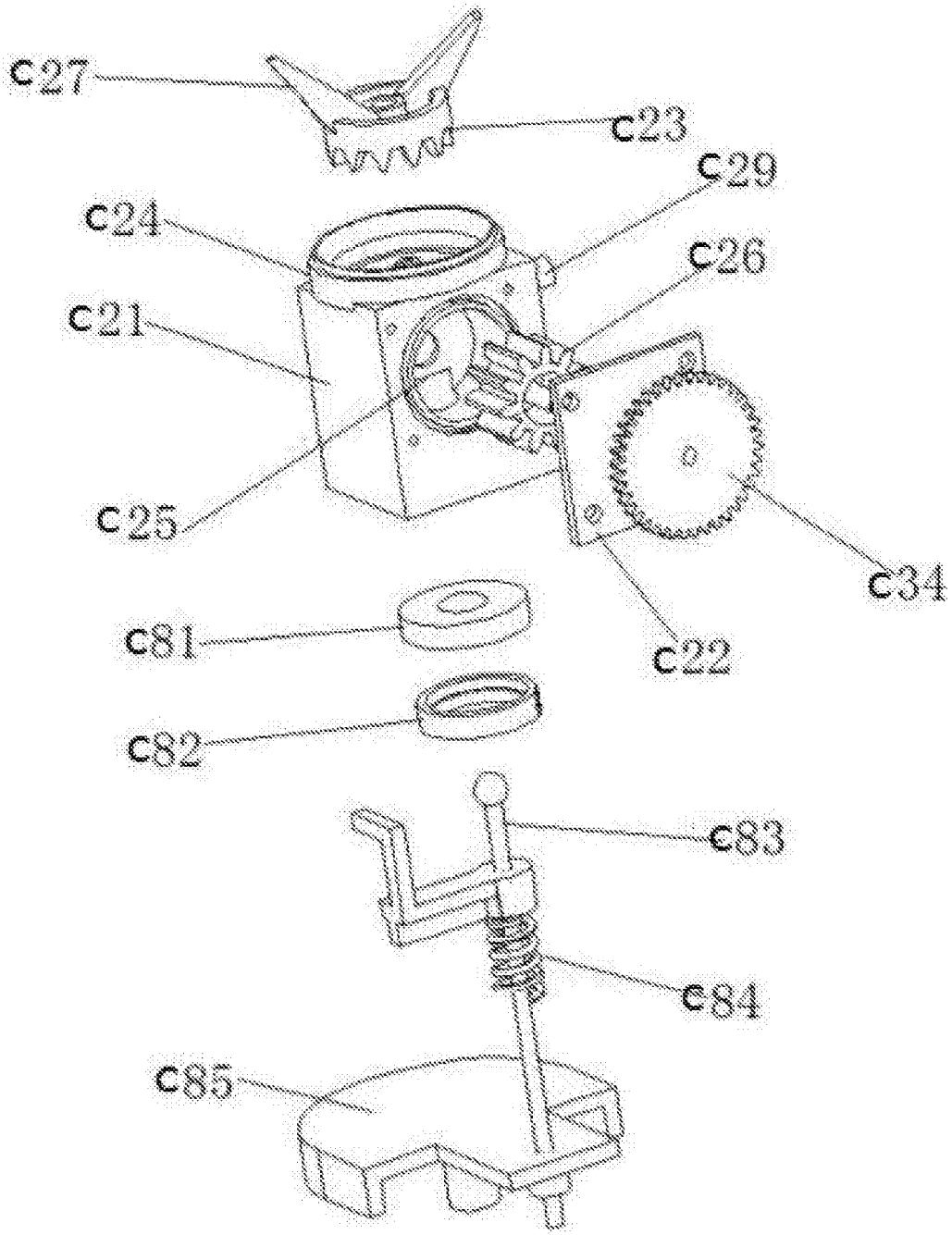
FIG. 26 is a structural side view of a connection of the mixing device and the trigger device of the soap dispenser in embodiment 3.
Figure 27:
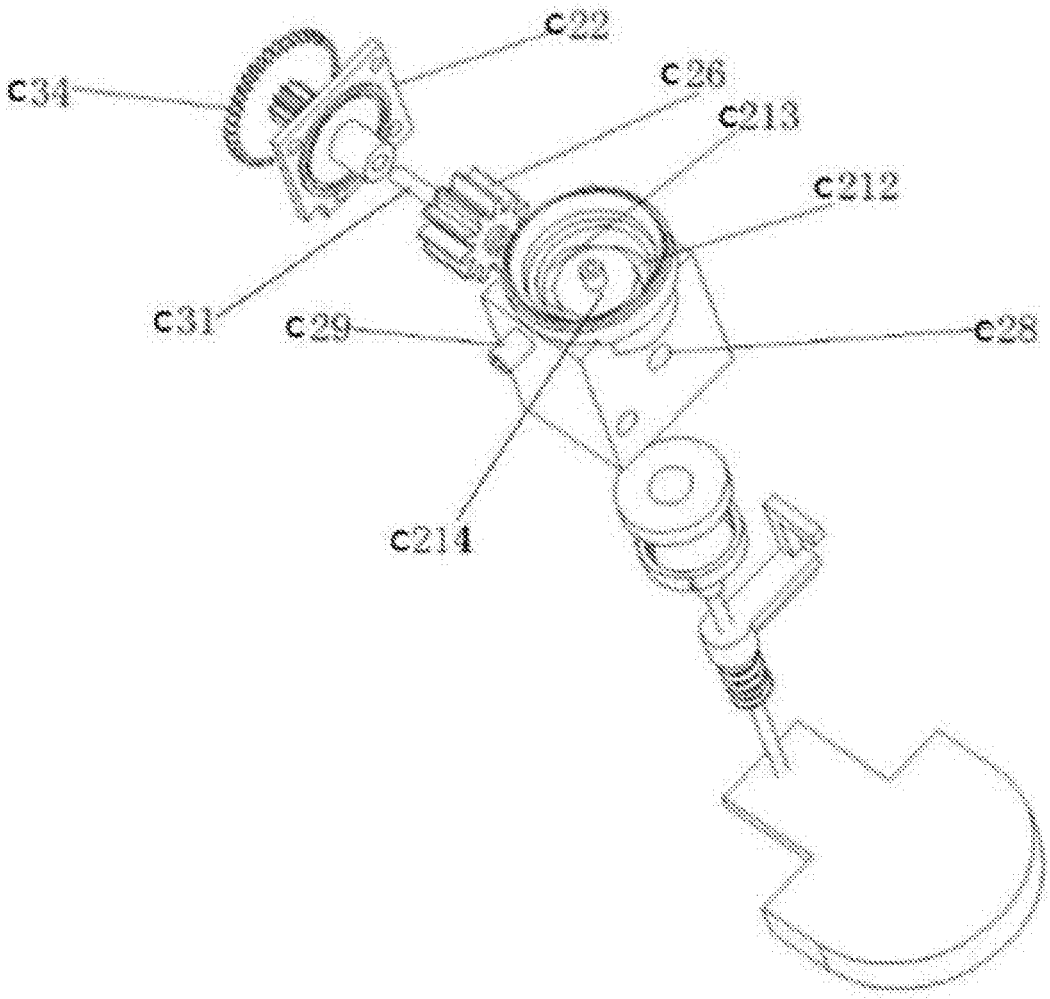
FIG. 27 is a structural top view of the connection of the mixing device and the trigger device of the soap dispenser in embodiment 3.
Figure 28:
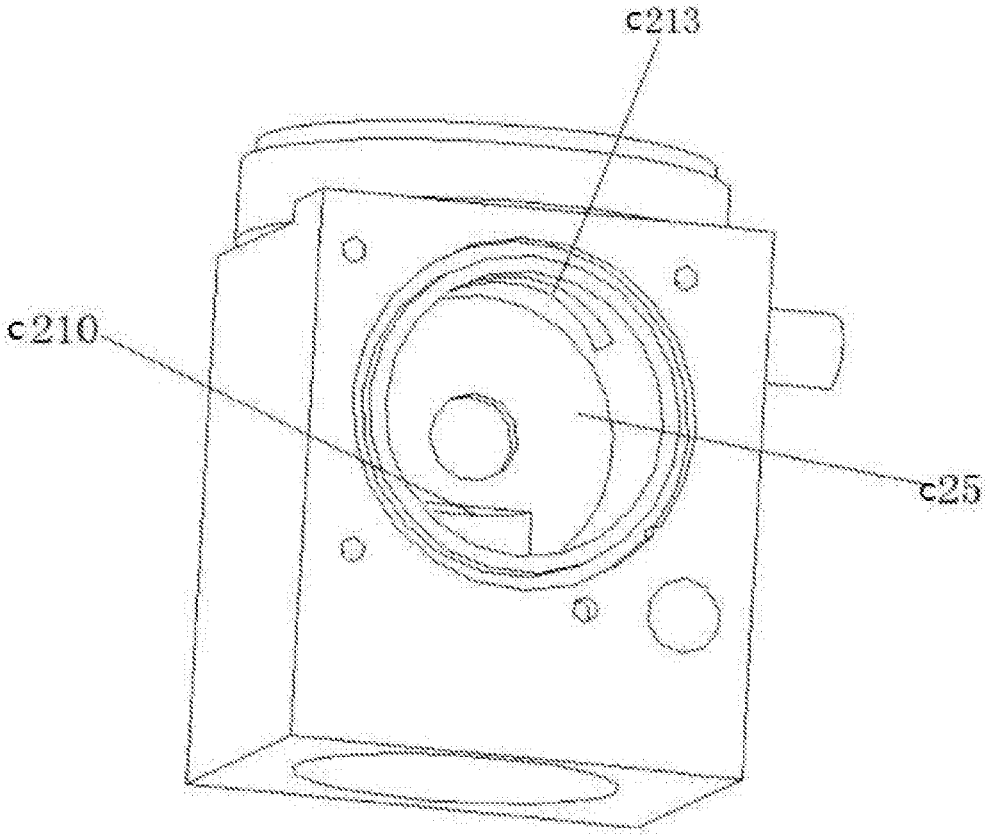
FIG. 28 is a structural diagram of the mixing device of the soap dispenser viewed from a transmitting chamber located in a side of a housing in embodiment 3.
Figure 29:
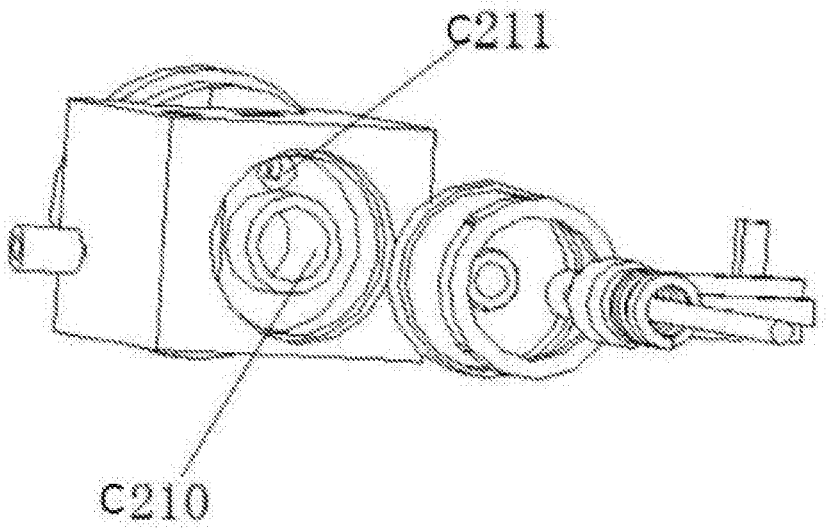
FIG. 29 is a structural diagram of the mixing device of the soap dispenser viewed from a first and a second mixed liquid outlets located in a lower portion of the housing in embodiment 3.
Figure 30:
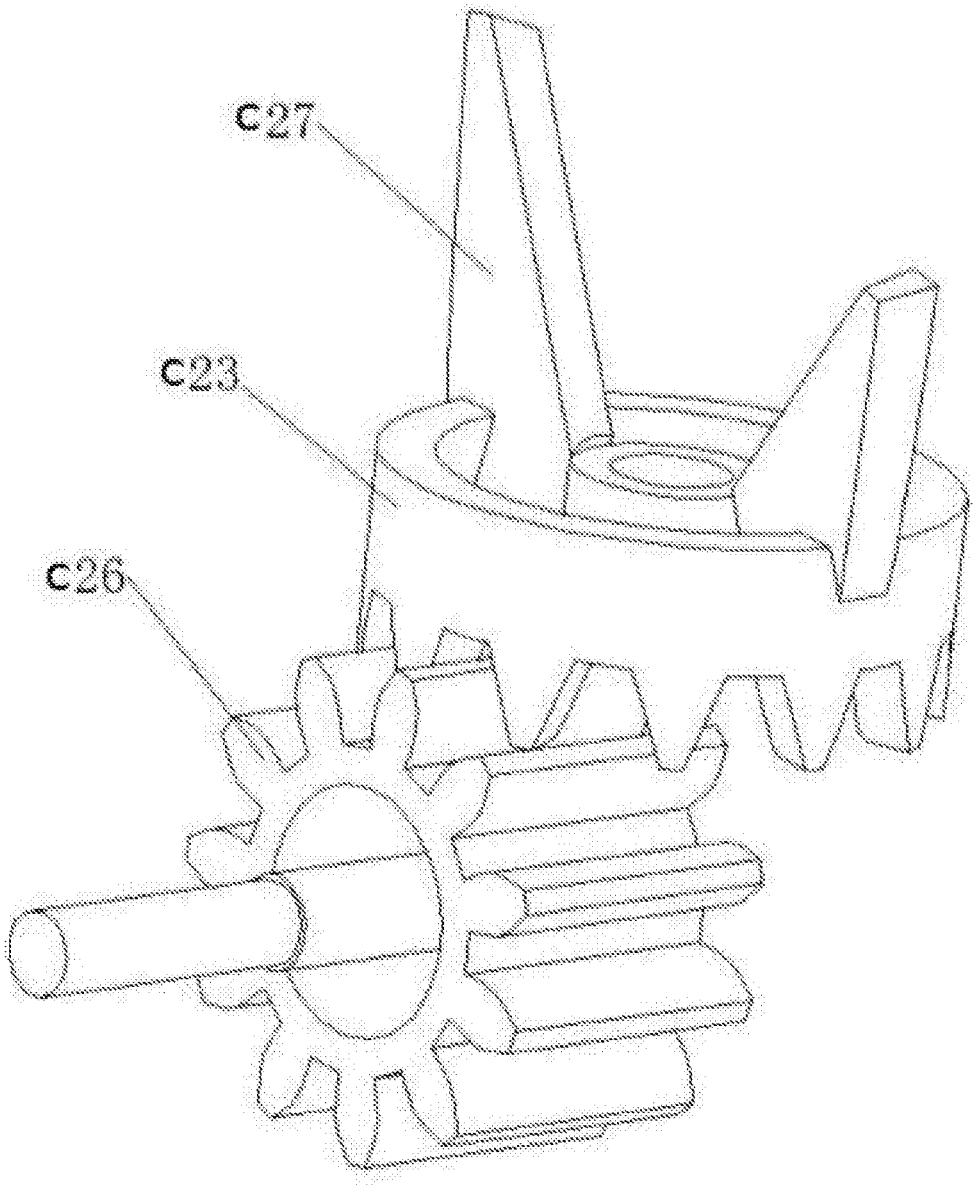
FIG. 30 is a structural diagram of an engagement of a mixing crown gear and a mixing straight gear of the mixing device of the soap dispenser in embodiment 3.
Figure 31:
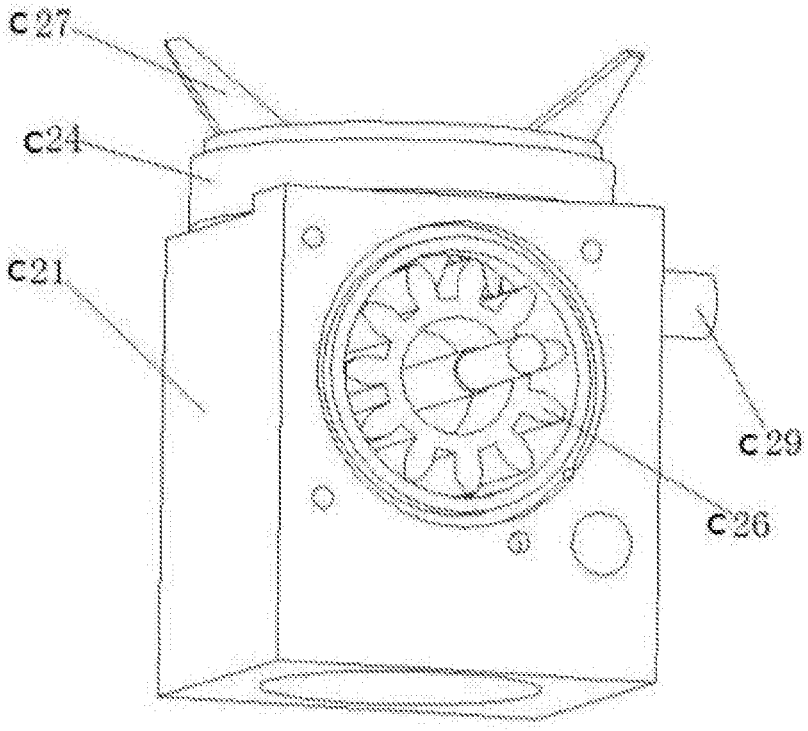
FIG. 31 is a structural schematic view of the mixing straight gear of the mixing device of the soap dispenser mounted inside the mixing housing in embodiment 3.

Referring to FIGS. 24, 25, and 27, in embodiment 3, the drive device c3 includes a rotary shaft c31, a transmission component, a drive motor c33, a first gear c34, a second gear c35, and the drive shaft c36. The drive motor c33 is used as power source for the entire drive-pump device c3.

Furthermore, an output terminal of the drive motor c33 is externally connected to a third gear c37. The third gear c37 is externally engaged with the second gear c35. The second gear c35 is a gear set, substantially. The gear set is externally engaged with the first gear c34, so that the rotation of both the second gear c35 and first gear c34 is directly actuated by the drive motor c33.

The second gear c35 is mounted on one drive shaft c36. The drive shaft c36 extends laterally to the main gear c42 or pinion c43, all of which are connected to the foaming device c4, so as to actuate the foaming device c4.

The first gear c34 is mounted on one rotary shaft c31 parallel to the drive shaft c36. An end of the rotary shaft c31 is connected to the mixing straight gear c26 of mixing device c2, so as to actuate the mixing device c2.

The transmission component is connected to the rotary shaft c31 and actuates the pumping component c7. Specifically, the transmission component includes an eccentric c32 peripherally sheathed around the rotary shaft c31. An end of the connecting rod c711 of the pressure pump c71 is sheathed on the eccentric c32. When the rotary shaft c31 actuates the eccentric c32 to rotate, the connecting rod c711 will reciprocate, so as to actuate the pumping of pressure pump c71. Designers or users can design the eccentric c32 with different eccentric distances to adjust the pumping capacity of the pressure pump c71.

Additionally, referring to FIGS. 24, 25, 26, and 27, the soap dispenser further includes a trigger device electrically connected to the drive motor c33 to provide the user a simple switch on-off of the drive motor c33. The trigger device includes a pressing plate c85, a trigger connecting rod c83, a trigger switch, and a linkage plate. A main body of the pressing plate c85 is exposed outside the housing c1 for easy operation. One end of the pressing plate c85 is laterally hinged to a bottom of the housing c1. The other end of the pressing plate is a free end which can be pressed. The trigger connecting rod c83 is vertically arranged perpendicular to the hinge shaft of the pressing plate c85. A bottom end of the trigger connecting rod c83 is connected to the free end, and a top end thereof is fixed to the linkage plate. The trigger switch is a press-button switch located above the pressing plate c85 and fixed to the housing c1. The trigger switch is located in the vertical translation path of the linkage plate. When the user presses or steps the pressing plate c85, the linkage plate descends along the vertical direction subsequently as the trigger connecting rod c83 descends immediately. The trigger switch is triggered during the descending process. Thereafter, the drive motor c33 and drive-pumping device c3 are actuated. In order to make trigger connecting rod c83 translate to a reset position upwardly after releasing the pressing plate c85, a periphery of the trigger connecting rod c83 sheathed at a lower end surface of the linkage plate is provided with a reset spring c84, and the bottom end of the reset spring c84 is connected to the housing c1. A connecting rod of the trigger device is connected with the valve rubber c81. The valve rubber c81 is well fixed by a valve fixing ring c82. The valve rubber seals the first mixed liquid outlet when the valve rubber is not operating. When the pressing plate is pressed down, the connecting rod is pulled, and the valve rubber is opened by pulling the connecting rod, so that the first mixed liquid outlet is opened. The mixed liquid is transmitted from the first mixed liquid outlet to the second mixed liquid outlet, and then to the third mixed liquid outlet through the transmitting chamber. Finally, the mixed liquid is fed to the foaming device via a mixed liquid input port thereof from the third mixed liquid outlet.

Accordingly, in the embodiment, only by pressing the pressing plate, drive-pumping device c3 can be actuated, simultaneously. The drive-pumping device c3 actuates the mixing device c2 and the foaming device c4 subsequently. Moreover, the feed port (the third mixed liquid outlet) of the mixing device c2 connected to the foaming device c4 is opened, such that an integral operation of the drive-pumping device c3, the mixing device c2, and the foaming device c4 can be realized. When the pressing plate is released, the drive-pumping device c3, the mixing device c2, and the foaming device c4 are closed. Its degree of automation is significantly improved.

The brief operation of embodiment 3 is as follows.

When the trigger device is triggered, the pumping component c7, the mixing device c2, and the foaming device c4 are actuated by the drive-pump device c3, simultaneously. Water is supplied to the mixing device c2 by the pumping component c7 at a proportion. At the same time, the mixing device c2 draws in the raw material from the raw material chamber c5, proportionally to mix and stir with water sufficiently. Thereafter, a diluted mixture is formed, and the mixture is subsequently fed to the foaming device c4 for foaming. Finally, the foam soap is discharged from the soap dispenser via the spray nozzle.

Embodiment 4

Referring to FIGS. 36-40, a foam soap dispenser with high mixing accuracy includes a water tank d1, a raw material tank d2, a foaming device d3, a mixing device d5, a drive device d6, a mixed liquid pumping-transmitting device d4, and a liquid pumping-transmitting device d7. The mixed liquid pumping-transmitting device d4 and the liquid pumping-transmitting device d7 are separately designed. The liquid pumping-transmitting device d7 includes a first cam d71, a first connecting rod d72, a first pressure pump d73, a check valve d74, and a first one-way valve d75. A water outlet of the first one-way valve d75 is connected to a water inlet of the first pressure pump d73. The mixed liquid pumping-transmitting device d4 includes a second pressure pump d41, a third one-way valve d42, a second one-way valve d43, a second cam d44, and a second connecting rod d45. A water outlet of the second one-way valve d43 is connected to a water inlet of the second pressure pump d41. A water outlet of the second pressure pump d41 is connected to a water inlet of the third one-way valve d42. The mixing device d5 includes a water inlet d51, a first mixed liquid outlet d52, a stirring chamber d53, a second mixed liquid outlet d54, a rotary connecting shaft d55, a mixing gear d56, a mixing cover d57, a stirring gear d58, a mixing housing d59, a seal ring d510 and a mixing chamber d512. A liquid inlet of the mixed liquid pumping-transmitting device d4 is connected to the second mixed liquid outlet d54 of the mixing device d5 via the second one-way valve d43. A liquid outlet of the mixed liquid pumping-transmitting device d4 is connected to a water inlet of the foaming device d3 via the third one-way valve d42. A liquid inlet of the liquid pumping-transmitting device d7 is connected to a water outlet of the water tank d1 via the first one-way valve d75. A liquid outlet of the liquid pumping-transmitting device d7 is connected to the water inlet d51 of the mixing device d5 via the check valve d74. The drive device d6 is connected to the foaming device d3, the mixed liquid pumping-transmitting device d4, the mixing device d5, and the liquid pumping-transmitting device d7, and serves as power source for the foaming device d3, the mixed liquid pumping-transmitting device d4, the mixing device d5, and the liquid pumping-transmitting device d7 simultaneously.

Figure 43:
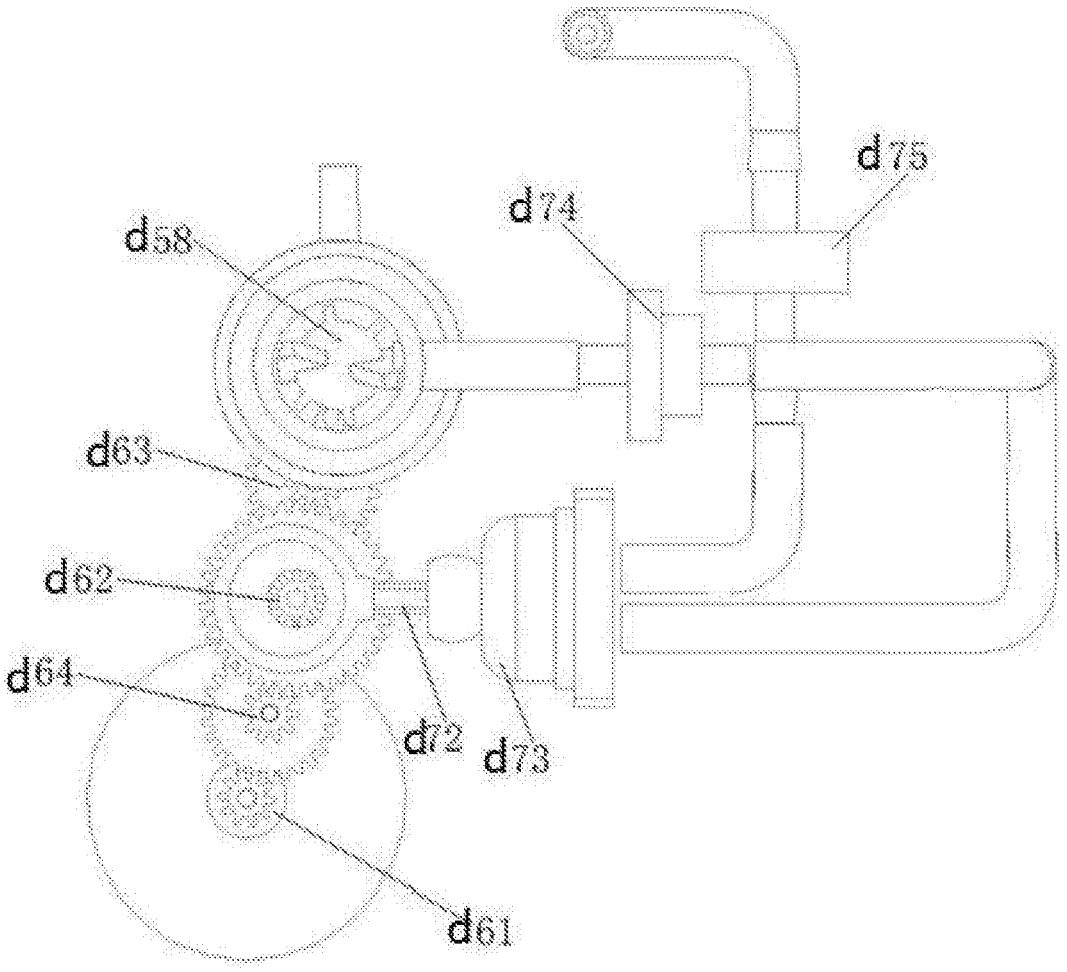
FIG. 43 is a structural schematic view of a connection of the liquid pumping-transmitting device and the drive device in embodiment 4 of the present invention.
Figure 44:
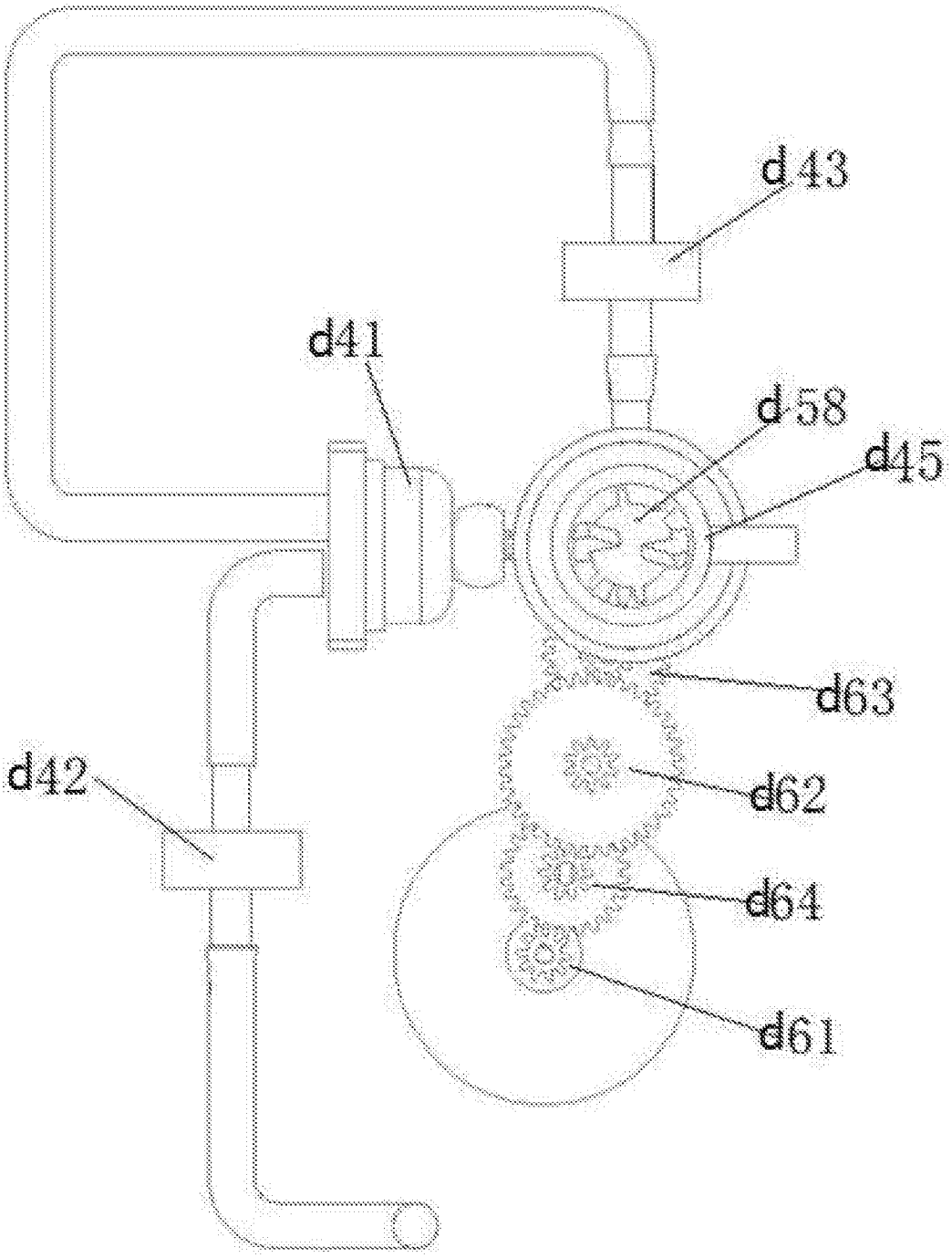
FIG. 44 is a structural schematic view of a connection of the mixed liquid pumping-transmitting device and the drive device in embodiment 4 of the present invention.

As shown in FIGS. 43 and 44, in embodiment 4, the drive device d6 includes a motor gear d61, a center gear d62, a first auxiliary gear d63, a second auxiliary gear d64, and a third auxiliary gear d65. The motor gear d61 is engaged with the second auxiliary gear d64 of which rotation is actuated by the motor gear d61. The second auxiliary gear d64, the center gear d62, the first auxiliary gear d63, and the third auxiliary gear d65 are engaged in sequence.

Figure 39:
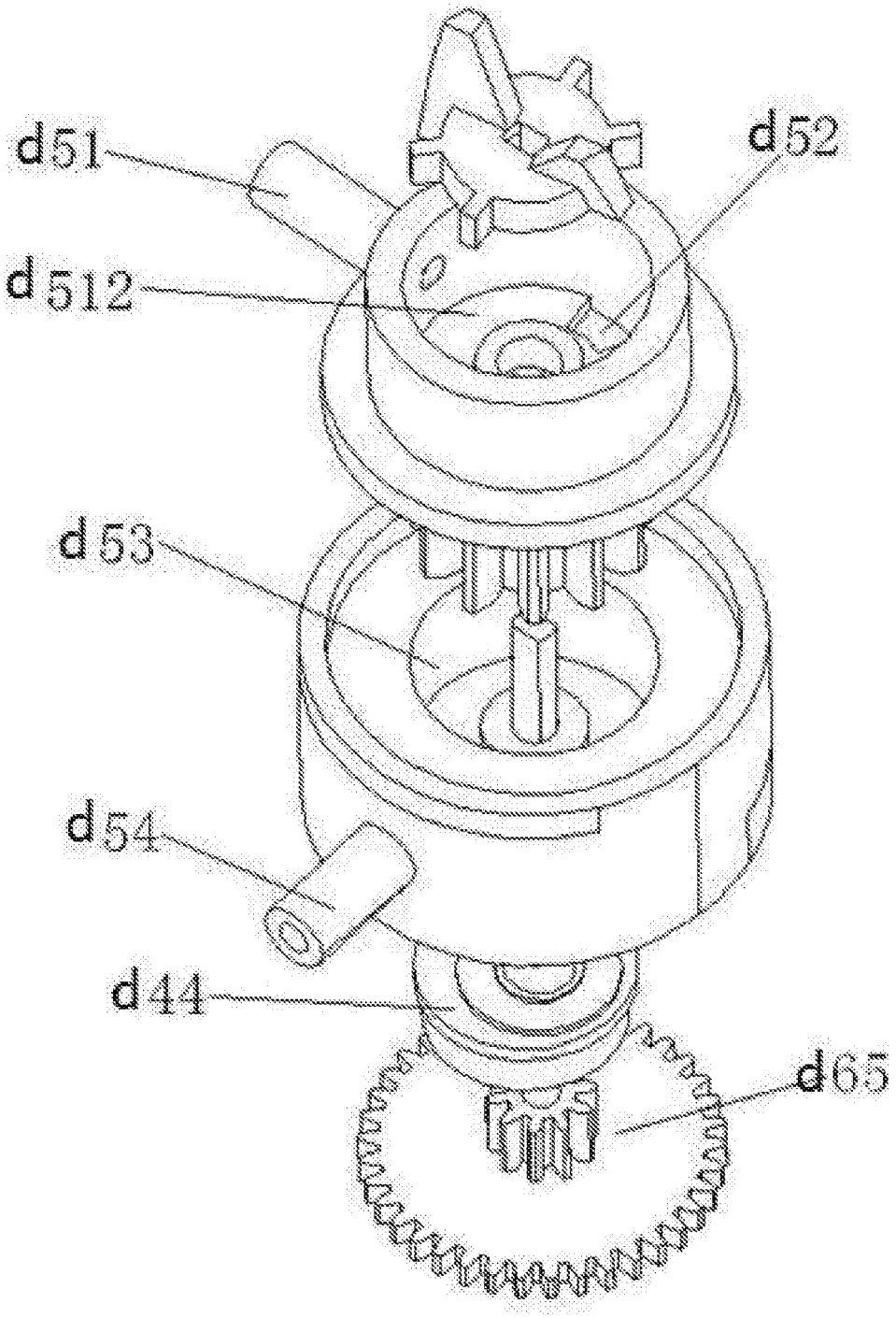
FIG. 39 is a structural schematic view of an exterior of a mixing device in embodiment 4 of the present invention.
Figure 40:
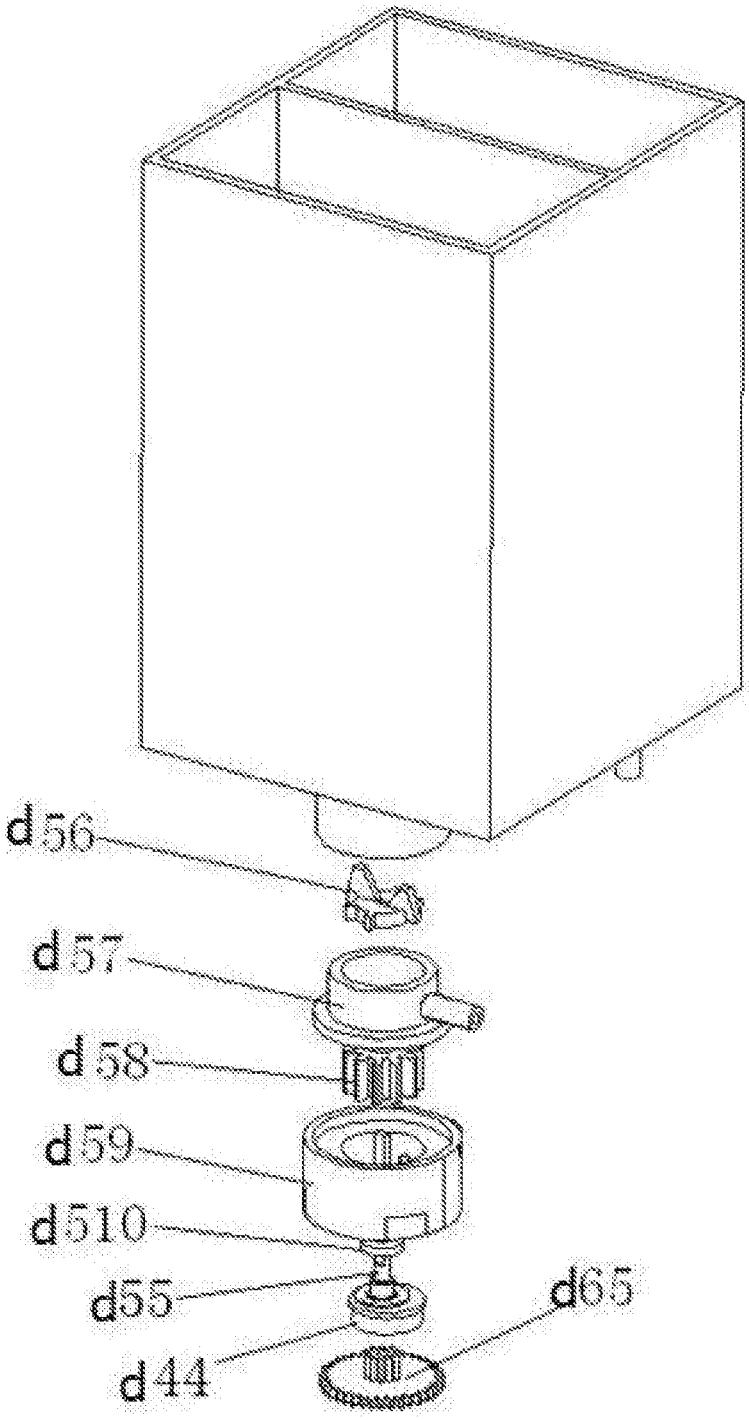
FIG. 40 is a structural exploded view of the mixing device in embodiment 4 of the present invention.

As shown in FIGS. 39 and 40, in embodiment 4, the water inlet d51 is arranged on the mixing cover d57. The mixing gear d56 is arranged inside the mixing cover d57. The stirring gear d58 is arranged in the stirring chamber d53 inside the mixing housing d59. The stirring chamber d53 is provided with the second mixed liquid outlet d54. The mixing cover d57 is further provided with the first mixed liquid outlet d52. The stirring gear d58 and the mixing gear d56 are connected to an upper portion of the rotary connecting shaft d55. A connection point of the stirring gear d58 and the rotary connecting shaft d55 is provided with the seal ring d510. A lower portion of the rotary connecting shaft d55 is connected to the second cam d44.

Figure 41:
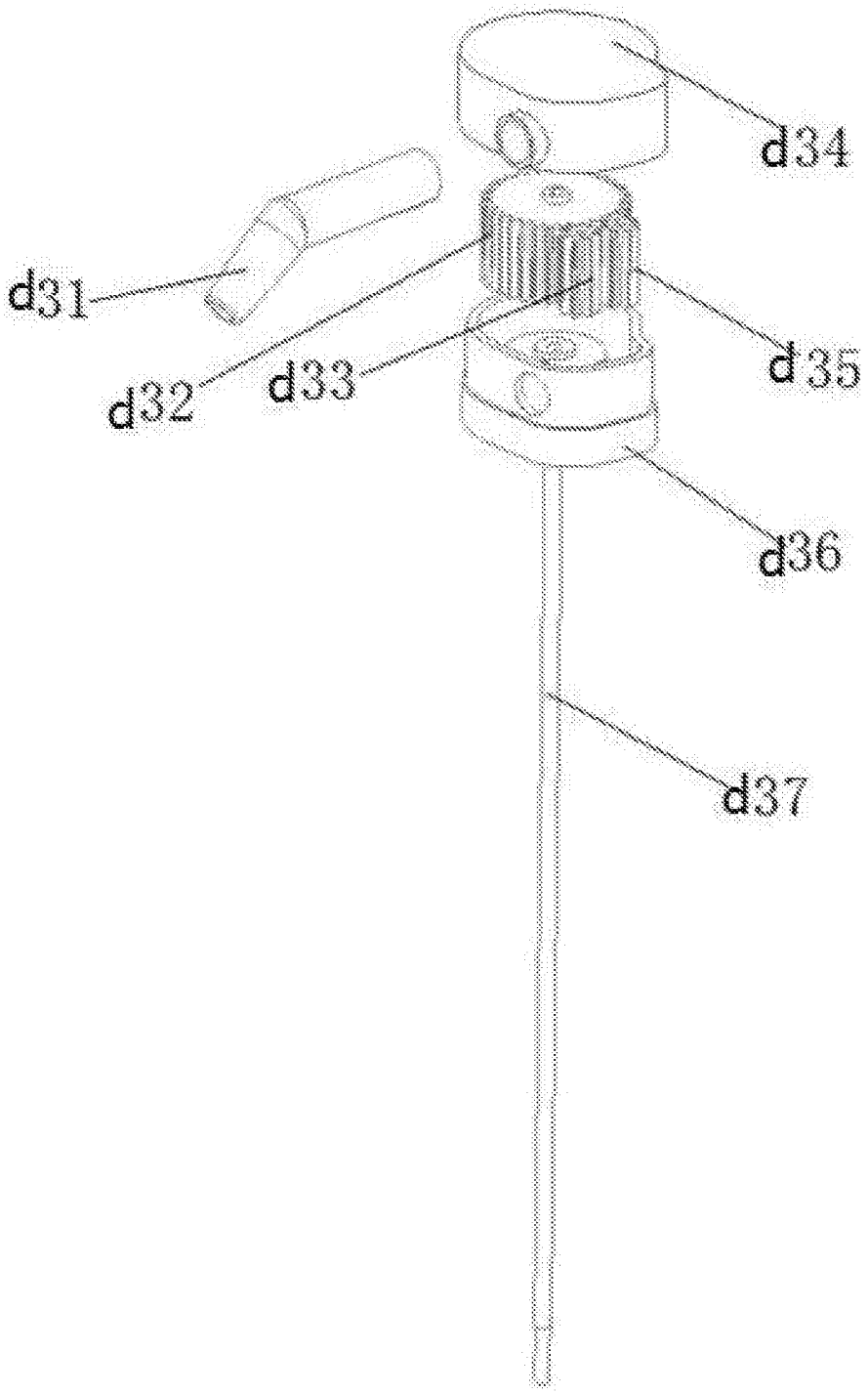
FIG. 41 is a structural schematic view of a foaming device in embodiment 4 of the present invention.
Figure 42:
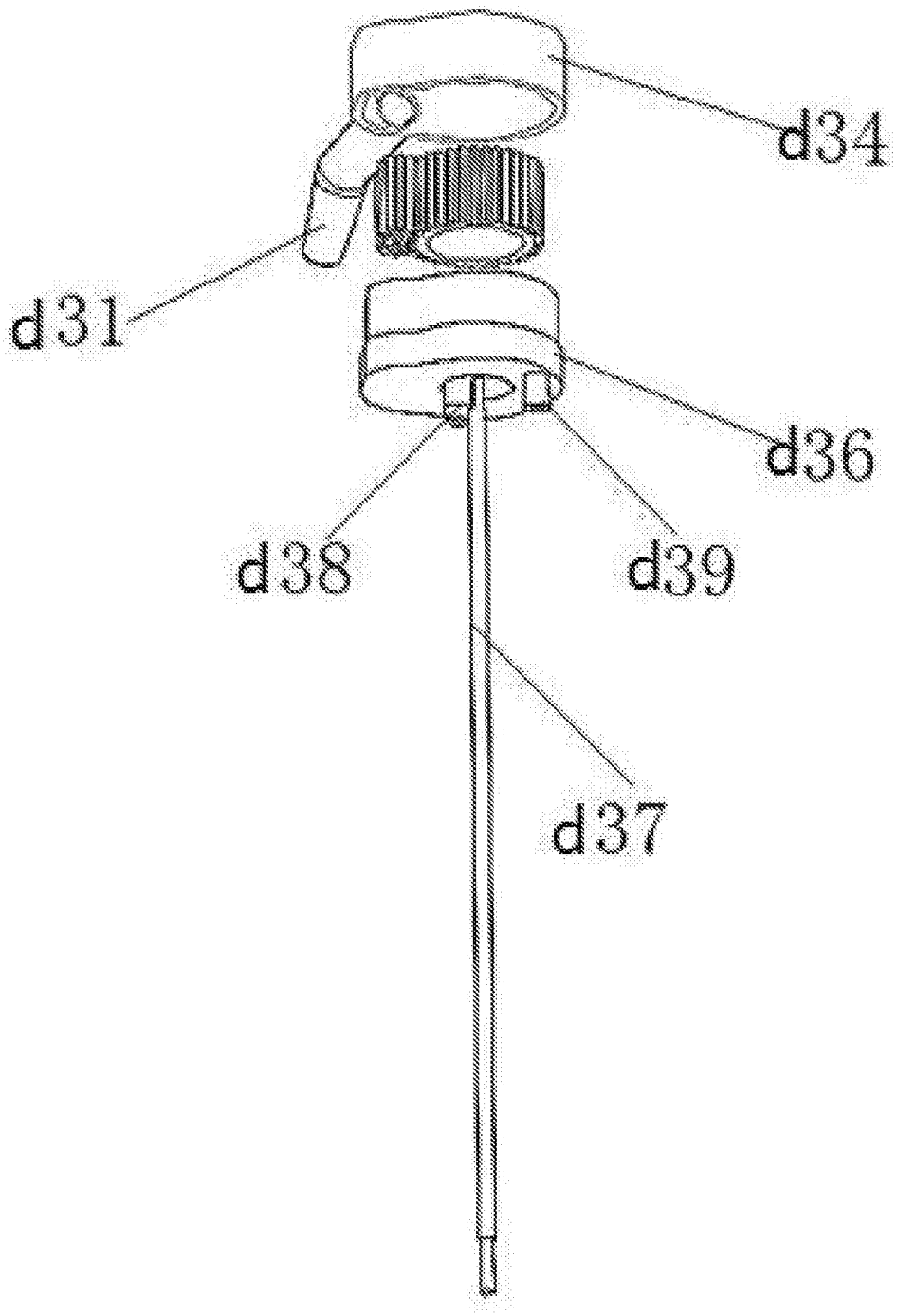
FIG. 42 is a structural schematic view of the foaming device viewed from another direction in embodiment 4 of the present invention.

As shown in FIGS. 41 and 42, the foaming device d3 includes a spray nozzle d31, a main gear d32, a first pinion d33, an upper foaming housing d34, a second pinion d35, a lower foaming housing d36, a drive shaft d37, an air inlet d38, and a mixed liquid inlet d39. An upper portion of the drive shaft d37 is connected to the main gear d32. The main gear d32 is engaged with the first pinion d33 and the second pinion d35. The main gear d32, the first pinion d33, and the second pinion d35 are arranged inside a housing formed by a snap-fit of the upper foaming housing d34 and the lower foaming housing d36. The spray nozzle d31 is arranged on the upper foaming housing d34. The lower foaming housing d36 is provided with the air inlet d38 and the mixed liquid inlet d39. A lower portion of the drive shaft d37 is connected to the second auxiliary gear d64. An upper portion of the drive shaft d37 is connected to the main gear d32.

In embodiment 4, the third auxiliary gear d65 is connected to and actuates the second cam d44.

In embodiment 4, a rotation of first cam d71 is actuated by the center gear d62. The first cam d71 is extended through an annular ring located at a side of first connecting rod d72. Another side of the first connecting rod d72 is connected to the cup arranged on the first pressure pump d73. The second cam d44 is extended through an annular ring located at a side of the second connecting rod d45. Another side of the second connecting rod d45 is connected to the cup arranged on the second pressure pump d41.

In embodiment 4, the first cam d71 and second cam d44 both have an eccentric structure.

In embodiment 4, the mixing gear d56 is provided with an inserting hole.

In operation, the motor gear d61 actuates the second auxiliary gear d64 to rotate. Since the second auxiliary gear d64, the center gear d62, the first auxiliary gear d63, and the third auxiliary gear d65 are engaged in sequence, the center gear d62, the first auxiliary gear d63, and the third auxiliary gear d65 will also rotate.

The rotation of the center gear d62 is actuated by the motor gear d61 via the second auxiliary gear d64. The rotation of the first cam d71 is actuated by the center gear d62. The first connecting rod d72 is actuated by the first cam d71. Since the first cam d71 has an eccentric structure, the first connecting rod d72 will reciprocate in a horizontal direction. The cup of first pressure pump d73 is actuated to squeeze and retract, circularly, by the first connecting rod d72. After water enters the water inlet of the first pressure pump d73 through the first one-way valve d75 from the water tank, the liquid is transmitted to the water inlet d51 of the mixing device d5 from the water outlet of the first pressure pump d73 through the check valve d74 to enter the mixing chamber d512. The liquid pumping-transmitting device d7 is actuated to operate by the drive device d6 in such a manner.

The rotation of the second cam d44 is actuated by the third auxiliary gear d65. The second cam d44 actuates the stirring gear d58 to rotate, and then the stirring gear d58 actuates the mixing gear d56 to rotate. The mixing device d5 is actuated to operate by the drive device d6 in such a manner. The water inlet d51 of the mixing device d5 is arranged on the mixing cover d57. The mixing gear d56 is arranged inside the mixing cover d57. The stirring gear d58 is arranged in the stirring chamber d53 inside the mixing housing d59. The stirring chamber d53 is provided with the second mixed liquid outlet d54. The mixing cover d57 is further provided with the first mixed liquid outlet d52. The stirring gear d58 is connected to the upper portion of the rotary connecting shaft d55. The connection point of the stirring gear d58 and the rotary connecting shaft d55 is provided with the seal ring d510. The lower portion of the rotary connecting shaft d55 is connected to the second cam d44.

Raw material is fed into the mixing chamber d512 of an upper cover of the mixing device d5 from an outlet of the raw material tank d2. Water is fed into the mixing chamber d512 through the water inlet d51 by the liquid pumping-transmitting device d7. Moreover, the water and raw material are stirred and mixed by the mixing gear d56. The mixed liquid flows into the stirring chamber d53 from the first mixed liquid outlet d52 to be stirred again by the stirring gear d58. Thereafter, the mixed liquid is pumped into the mixed liquid pumping-transmitting device d4 from the second mixed liquid outlet d54.

An water inlet of the second one-way valve d43 of the mixed liquid pumping-transmitting device d4 is connected to the second mixed liquid outlet d54 of above-mentioned mixing device d5 to pump the mixed liquid into it. The water outlet of the second one-way valve d43 is connected to the water inlet of the second pressure pump d41. The water outlet of the second pressure pump d41 is connected to the water inlet of the third one-way valve d42. A water outlet of the third one-way valve d42 is connected to the water inlet of the foaming device d3.

In operation, the rotation of the second cam d44 is actuated by the third auxiliary gear d65. The second cam d44 is extended through an annular ring located in one side of the second connecting rod d45. The other side of the second connection rod d45 is connected to the cup of the second pressure pump d41. Since second cam d44 has an eccentric structure, when the second cam is rotating, the second connecting rod d45 will reciprocate so as to actuate the cup to compress and expand, continuously, so that the second pressure pump d41 can operate. In such a manner, the mixed liquid in the mixing housing enters the second one-way valve d43 through the second mixed liquid outlet d54, and thus enters the second pressure pump d41. After mixing, the mixture enters into the foaming device d3 through the mixed liquid inlet d39 of the foaming device d3 via the third one-way valve d42.

Since the lower portion of the drive shaft d37 of the foaming device d3 is connected to the second auxiliary gear d64, the rotation of the second auxiliary gear d64 is directly actuated by the motor gear d61. The drive shaft d37 rotates while the motor gear d61 rotates. The drive shaft d37 actuates the main gear d32 to rotate. The main gear d32 actuates the first pinion d33 and the second pinion d35 to rotate. The rotation of the main gear d32, the first pinion d33, and the second pinion d35 makes the mixture in the foaming device d3 grind with air to produce soap foam, which is discharged from the nozzle d31 of the foaming device d3.

To conclude, the brief working principle of each module of the present invention is as below. When the motor is operating, the gear set will rotate. Firstly, the liquid transmitting device is actuated to operate. Water enters into the mixing device through the liquid pumping-transmitting device from the water tank. Meanwhile, raw material enters the mixing device from the raw material tank. The water and raw material are mixed together in the mixing device at a certain proportion to obtain the mixed liquid. The mixed liquid is transmitted to the foaming device through the mixed liquid pumping-transmitting device. The mixed liquid is mixed with the air in the foaming device and then discharged from the spray nozzle.

The mixed liquid pumping-transmitting device and the liquid pumping-transmitting device of the present invention are separately designed, such that the water and raw material are accurately mixed at a proportion to produce more plentiful foam. For example, when the shampoo foam is to be produced, the preferred ratio of water to shampoo is 2:1, and two dose of water are pumped into the mixing device by the liquid pumping-transmitting device in each operation, while three dose of mixed liquid can be pumped from the mixing device by the mixed liquid pumping-transmitting device, so that the ratio of water to shampoo can be controlled to 2:1 accurately. Therefore, a perfect mixture can be produced, and the foaming device can achieve a better foam effect.

The preferred embodiments of the present invention are described in detail above. It should be understood that those skilled in the art will be able to make various modifications and variations in accordance with the teachings of the present invention without any creative efforts. Accordingly, the technical solutions that can be achieved by those skilled in the art through logical analysis, deduction, or limited experiments based on the prior art in accordance with the teachings of the present invention, will fall within the scope defined by the appended claims.

What is claimed is:

1. A foam soap dispenser comprises a housing, a raw material chamber, and a liquid soap outlet, wherein the foam soap dispenser further comprises a water chamber, a drive device, and a foaming device; the liquid soap outlet is arranged on the housing; the raw material chamber, the water chamber, the drive device, and the foaming device are arranged inside the housing; a raw material chamber outlet and a water chamber outlet are connected to a foaming device inlet; a foaming device outlet is connected to the soap liquid outlet;

wherein the foam soap dispenser further comprises a mixing device, and a drive-pumping device; the mixing device includes a feed port connected to a discharge port of the raw material chamber, a water inlet connected to a water outlet of the water chamber, and a discharge port connected to the foaming device inlet the liquid soap outlet is connected to the foaming device; the drive-pump device is connected to the mixing device and the foaming device, and serves as power source for the mixing device and the foaming device simultaneously; wherein, the mixing device includes a mixing-diluting-transmitting housing and a mixing vessel arranged on an upper portion of the mixing-diluting-transmitting housing; a side of a mixing-diluting-transmitting housing is provided with a transmitting chamber opening so as to form a transmitting chamber inside the mixing-diluting-transmitting housing; the transmitting chamber is internally provided with a mixing straight tooth gear; the mixing vessel is internally provided with a mixing crown gear; a bottom of the mixing vessel is further provided with a mixing port connected to the transmitting chamber; an upper portion of the mixing crown gear is provided with a stirring piece; a central position of the mixing vessel is provided with a crown gear fixing cotter for fixing the mixing crown gear; a space between an outer rim of the crown gear fixing cotter and an inner rim of the mixing vessel forms a mixing groove; a lower portion of the mixing crown gear and the mixing straight tooth gear are engaged with each other in a mixing opening of the mixing groove; the mixing openings are arranged at an engaging point of the mixing crown gear and the mixing straight tooth gear.

2. The foam soap dispenser of claim 1, wherein the transmitting chamber opening of the mixing-diluting-transmitting housing is provided with a transmitting chamber cover for covering the transmitting chamber; the center of the transmitting chamber cover is sheathed around the rotary shaft, which rotary shaft is connected to the mixing straight gear; the mixing straight gear is covered inside the transmitting chamber by means of the transmitting chamber cover; an upper portion of a side adjacent to a transmitting chamber opening side of the mixing-diluting-transmitting housing is provided with a water inlet connected to the water chamber; the water inlet is connected to the mixing groove; a lower portion of the mixing-diluting-transmitting housing is further provided with a first mixed liquid outlet and a second mixed liquid outlet; wherein, the first mixed liquid outlet is connected to the transmitting chamber; and the first mixed liquid outlet is connected to the second mixed liquid outlet; a side opposite to the transmitting chamber opening side of the mixing-diluting-transmitting housing is provided with a third mixed liquid outlet; the third mixed liquid outlet is connected to the second mixed liquid outlet; the third mixed liquid outlet is further connected to a liquid inlet of the foaming device.

3. The foam soap dispenser of claim 1, wherein a flow-adjustable pumping component is provided between the water outlet of the water chamber and the water inlet of the mixing device; the pumping component is connected to the drive-pumping device, and the drive-pumping device is used as power source for the pumping component; wherein, the drive-pumping device includes the rotary shaft connected to the mixing straight gear and the transmission component connected to the rotary shaft; the transmission component is connected to and actuates the pumping component; further wherein, the pumping component includes the pressure pump; the pressure pump includes a cup connecting rod which reciprocates to actuate the operation of the pressure pump; the transmission component includes the eccentric sheathed on the rotary shaft; an end of the cup connecting rod is sheathed on the eccentric; the pipe that connects the pressure pump outlet and the water inlet of the mixing device are provided with a water shutoff valve.

4. The foam soap dispenser of claim 3, wherein the water shutoff valve comprises the valve housing, the inner housing fitted within the valve housing, and a cross-shaped valve elastic sheet held between the valve housing and the inner housing; wherein, the valve housing is provided with the valve outlet; the inner housing is provided with the valve inlet; the flowing channel is formed between the valve inlet and the valve outlet; a blocking part of the cross-shaped valve elastic sheet corresponding to the flowing channel is provided with an opening slit; and the blocking part is divided into a plurality of retractable elastic valves by the opening slit.

5. The foam soap dispenser of claim 3, wherein the drive-pumping device comprises a drive motor; wherein, an output terminal of the drive motor is externally connected with a third gear; the third gear is externally engaged with the second gear; the second gear is externally engaged with the first gear; the first gear is mounted on the rotary shaft; an end of the rotary shaft is connected to the mixing straight gear of the mixing device, so as to actuate the mixing device.

6. The foam soap dispenser of claim 1, wherein foam soap dispenser further comprises a trigger device electrically connected to the drive-pumping device; wherein, the trigger device includes a valve rubber arranged at the first mixed liquid outlet, and a valve fixing ring for fixing the valve rubber; the valve rubber is connected to a pulling rod arranged below the valve rubber; a reset spring is sheathed around the pulling rod; a bottom of the pulling rod is connected to the pressing plate.

* * * * *